US011817258B2

(12) United States Patent
Ashtekar et al.

(10) Patent No.: US 11,817,258 B2
(45) Date of Patent: Nov. 14, 2023

(54) FLEXIBLE THOMSON COIL TO SHAPE FORCE PROFILE/MULTI-STAGE THOMSON COIL

(71) Applicant: EATON INTELLIGENT POWER LIMITED, Dublin (IE)

(72) Inventors: Koustubh Dnyandeo Ashtekar, Coraopolis, PA (US); Li Yu, Bridgeville, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/948,457

(22) Filed: Sep. 20, 2022

(65) Prior Publication Data

US 2023/0020292 A1 Jan. 19, 2023

Related U.S. Application Data

(62) Division of application No. 17/009,249, filed on Sep. 1, 2020, now Pat. No. 11,482,361.

(51) Int. Cl.

| | |
|---|---|
| ***H01F 7/00*** | (2006.01) |
| ***H01F 7/08*** | (2006.01) |
| ***H01F 7/06*** | (2006.01) |
| ***H01F 7/02*** | (2006.01) |
| ***H01F 27/28*** | (2006.01) |

(52) U.S. Cl.

CPC ..... *H01F 7/081* (2013.01); *H01F 7/02* (2013.01); *H01F 7/064* (2013.01); *H01F 27/28* (2013.01); *H01F 2007/086* (2013.01)

(58) Field of Classification Search

CPC . H01F 7/081; H01F 7/02; H01F 7/064; H01F 27/28; H01F 2007/086; H01F 5/00; H01F 7/122; H01F 7/08; H01H 33/285; H01H 33/666

USPC ..... 335/229

See application file for complete search history.

(56) References Cited

U.S. PATENT DOCUMENTS

| | | | | |
|---|---|---|---|---|
| 4,134,090 | A * | 1/1979 | Schuessler | H01H 51/2272 335/229 |
| 4,851,800 | A * | 7/1989 | Peterson | H01F 7/14 335/229 |
| 5,257,639 | A * | 11/1993 | Prescott | H01F 7/145 335/229 |
| 6,831,380 | B2 * | 12/2004 | Rybnicek | H01F 7/13 335/229 |
| 7,804,386 | B2 * | 9/2010 | Yonnet | F01L 9/20 335/229 |
| 10,410,813 | B1 * | 9/2019 | Ashtekar | H01H 33/6643 |
| 10,797,699 | B1 * | 10/2020 | Morrison | H01H 36/004 |
| 2006/0043798 | A1 * | 3/2006 | Konno | H02K 33/00 310/12.07 |
| 2016/0064169 | A1 * | 3/2016 | Ashtekar | H01H 33/7092 218/18 |

(Continued)

*Primary Examiner* — Shawki S Ismail
*Assistant Examiner* — Lisa N Homza
(74) *Attorney, Agent, or Firm* — Eckert Seamans Cherin & Mellott, LLC

(57) ABSTRACT

Coil-based actuators for use in opening and closing the separable contacts of circuit interrupters provide increased initial velocity for opening strokes and damping at the end of opening strokes. Electronics for adjusting the current profile of current supplied to coil-based actuators additionally provide increased initial velocity for opening strokes and damping at the conclusion of opening strokes.

11 Claims, 14 Drawing Sheets

(56) References Cited

U.S. PATENT DOCUMENTS

| | | | | |
|---|---|---|---|---|
| 2016/0064170 | A1* | 3/2016 | Ashtekar | H01H 33/88 218/14 |
| 2018/0025824 | A1* | 1/2018 | Kraemer | H01F 7/08 335/229 |
| 2018/0204659 | A1* | 7/2018 | Barbulescu | H01F 7/1805 |
| 2019/0080831 | A1* | 3/2019 | Sümegi | H01F 7/122 |
| 2020/0107110 | A1* | 4/2020 | Ji | A45C 13/005 |
| 2020/0358438 | A1* | 11/2020 | Casparian | H01F 7/0273 |

* cited by examiner

FLEXIBLE THOMSON COIL TO SHAPE FORCE PROFILE/MULTI-STAGE THOMSON COIL

BACKGROUND

Field

The disclosed concept relates generally to actuators used to open and close switches, and in particular, actuators used to open and close switches in circuit interrupters.

Background Information

Circuit interrupters, such as for example and without limitation, circuit breakers, are typically used to protect electrical circuitry from damage due to an overcurrent condition, such as an overload condition, a short circuit, or another fault condition, such as an arc fault or a ground fault. Circuit interrupters typically include separable electrical contacts, which operate as a switch. When the separable contacts are in contact with one another in a closed state, current is able to flow through any circuits connected to the circuit interrupter. When the separable contacts are not in contact with one another in an open state, current is prevented from flowing through any circuits connected to the circuit interrupter. The separable contacts may be operated either manually by way of an operator handle or automatically in response to a detected fault condition. Typically, such circuit interrupters include an actuator designed to rapidly close or open the separable contacts, and a trip mechanism, such as a trip unit, which senses a number of fault conditions to trip the separable contacts open automatically using the actuator. Upon sensing a fault condition, the trip unit trips the actuator to move the separable contacts to their open position.

Some circuit interrupters, such as, for example, power circuit breakers, employ vacuum interrupters as the switching devices. The separable electrical contacts usually included in vacuum interrupters are generally disposed on the ends of corresponding electrodes within an insulating housing that forms a vacuum chamber. Typically, one of the contacts is fixed relative to both the housing and to an external electrical conductor, which is electrically interconnected with a power circuit associated with the vacuum interrupter. The other contact is part of a movable contact assembly including an electrode stem of circular cross-section and a contact disposed on one end of the electrode stem and enclosed within a vacuum chamber. A driving mechanism is disposed on the other end, external to the vacuum chamber. When the trip unit detects a fault condition, the trip unit trips the actuator to cause the driving mechanism to open the separable contacts within the vacuum chamber. After the fault condition has resolved, the trip unit signals the actuator to cause the driving mechanism to drive the separable contacts closed within the vacuum chamber.

In medium and high voltage electrical systems in particular, the actuator of the circuit interrupter needs to be capable of driving the separable contacts open quickly in order to mitigate the effects of a fault condition. However, the force required to open separable contacts quickly is significant and can potentially damage any components connected to the driving mechanism at the end of the opening stroke. Furthermore, if the force used to open the separable contacts is too great, the driving mechanism may bounce at the end of the opening stroke and re-close the separable contacts before the fault condition has been resolved. In addition, closing separable contacts quickly also requires significant force, which can result in significant wear and tear on the separable contacts upon closing, necessitating that the separable contacts be replaced when they can no longer be relied upon to function properly.

There is thus room for improvement within actuators in circuit interrupters.

SUMMARY

These needs and others are met by embodiments of the disclosed concept in which a coil member, electrically connected to a current source, and a number of conductive members are structured to provide increased initial velocity for opening driving assemblies of circuit interrupters and damping at the conclusion of opening strokes. These needs and other are also met by embodiments of the disclosed concept in which electronics for adjusting the current profile of the current supplied to coil members of coil-based actuators additionally provide increased initial velocity for opening strokes and damping at the conclusion of opening strokes.

In accordance with one aspect of the disclosed concept, an actuator comprises: a shaft; first conductive member coupled to the shaft at a first location; a second conductive member coupled to the shaft at a second location; and a conductive coil disposed between the first and second conductive members and having an opening through which the shaft passes, wherein the coil is structured to be electrically connected to a current source, and wherein the first conductive member and the second conductive member are structured to move in response to changes in current supplied to the coil.

In accordance with another aspect of the disclosed concept, an actuator comprises: a shaft; a first conductive member coupled to the shaft at a first location; a second conductive member substantially toroidal in form and coupled to the shaft at a second location; and a conductive coil disposed between the first and second conductive members and having an opening through which the shaft passes, wherein the coil is structured to be electrically connected to a current source, and wherein the first conductive member and the second conductive member are structured to move in response to changes in current supplied to the coil.

In accordance with another aspect of the disclosed concept, an actuator comprises: a shaft; a first hinged conductive member comprising a plurality of first skirt portions, the first skirt portions being coupled to a first location of the shaft via a plurality of movable hinges at an interior end of the first skirt portions; a second hinged conductive member comprising a plurality of second skirt portions, the second skirt portions being coupled to a second location of the shaft via a plurality of movable hinges at an interior end of the second skirt portions; and a conductive coil member disposed between the first and second hinged conductive members and having an opening through which the shaft passes, wherein the coil is structured to be electrically connected to a current source, and wherein the first skirt portions and second skirt portions are structured to rotate about the movable hinges in response to changes in the current supplied to the coil.

In accordance with another aspect of the disclosed concept, an actuator comprises: a shaft; a multilayer coil member having an opening through which the shaft passes, the multilayer coil member comprising: a first housing and a plurality of first conductive coils provided within the first housing and structured to be electrically connected to a first current source; and a composite conductive member coupled to the shaft at a location separate from the multilayer coil member, the composite conductive member comprising: a second housing and a number of first ferromagnetic inserts provided within the second housing, and wherein the composite conductive member is structured to move relative to the multilayer coil member in response to changes in current supplied to the multilayer coil member.

In accordance with another aspect of the disclosed concept, an actuator comprises: a shaft comprising a plurality of steps; a first conductive telescoping arrangement disposed around the shaft at a first location of the shaft, the first conductive telescoping arrangement comprising: a plurality of first coil members, a plurality of first conductive members equal in number to the plurality of first coil members, and a first housing; and a second conductive telescoping arrangement coupled to the shaft at a second location of the shaft, the second conductive telescoping arrangement comprising: a plurality of second coil members, a plurality of second conductive members equal in number to the plurality of second coil members, and a second housing, wherein each of the first coil members corresponds to one first conductive member and one step, wherein each of the second coil members corresponds to one second conductive member and one step, wherein the first coil members and second coil members are structured to be electrically connected to a current source, wherein each first conductive member is structured to move between the corresponding first coil member and the corresponding step in response to changes in current supplied to the corresponding first coil member, and wherein each second conductive member is structured to move between the corresponding second coil member and the corresponding step of the shaft in response to changes in current supplied to the corresponding second coil member.

In accordance with another aspect of the disclosed concept, an electrical supply circuit for an actuator comprises: a main charging relay; a charging conductor connected to the main charging relay; a plurality of capacitor banks, each of the capacitor banks comprising: a capacitor, a two pole bank relay, and a diode; a discharging conductor; a main discharging relay; and a processor, wherein the main charging relay is structured to connect the charging conductor to a DC power source, wherein a charging pole of each of the bank relays is structured to connect the capacitor of each of the bank relays to the charging conductor, wherein the main discharging relay is structured to connect the discharging conductor to a conductor coil of the actuator, wherein a discharging pole of each of the bank relays is structured to connect the capacitor of each of the bank relays to the discharging conductor via the diode of each of the bank relays, and wherein the processor is structured to open and close the charging pole and discharging pole of each capacitor bank independently of the charging pole and discharging pole of each of the other capacitor banks.

In accordance with another aspect of the disclosed concept, an electrical supply circuit for an actuator comprises: a main charging relay; a charging conductor connected to the main charging relay; a number of capacitor banks, each of the capacitor banks comprising: a capacitor, a two pole bank relay, and a diode; a discharging conductor; a main discharging relay; a number of ramp-down circuits comprising: a resistor, an inductor connected in series with the resistor, a ramp-down switch; and a processor, wherein the main charging relay is structured to connect the charging conductor to a power source, wherein a charging pole of each of the bank relays is structured to connect the capacitor of each of the bank relays to the charging conductor, wherein the main discharging relay is structured to connect the discharging conductor to a conductor coil of the actuator, wherein a discharging pole of each of the bank relays is structured to connect the capacitor of each of the bank relays to the discharging conductor via the diode of each of the bank relays, wherein the ramp-down switch of each of the ramp-down circuits is structured to connect the ramp-down circuit to the conductor coil of the actuator, wherein the processor is structured to open and close the charging pole and discharging pole of each capacitor bank independently of the charging pole and discharging pole of each of the other capacitor banks, and wherein the processor is structured to open and close the ramp-down switch of each of the ramp-down circuits independently of the ramp-down switch of each of the other ramp-down circuits.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1A:
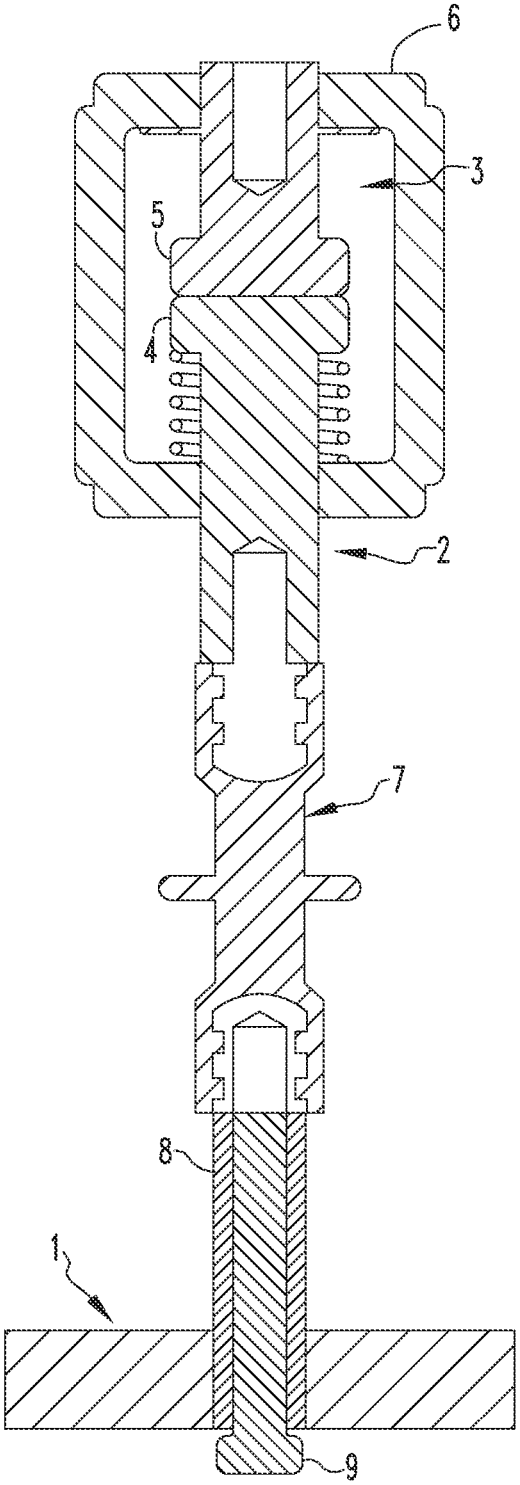
FIGS. 1A and 1B are diagrams of a schematically depicted actuator connected to a vacuum circuit interrupter in accordance with an example embodiment of the disclosed concept.

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

As used herein, the singular form of "a", "an", and "the" include plural references unless the context clearly dictates otherwise.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. As used herein, "movably coupled" means that two components are coupled so as to allow at least one of the components to move in a manner such that the orientation of the at least one component relative to the other component changes.

As employed herein, the term "processor" shall mean a programmable analog and/or digital device that can store, retrieve, and process data; a microprocessor; a microcontroller; a microcomputer; a central processing unit; or any suitable processing device or apparatus.

Figure 1B:
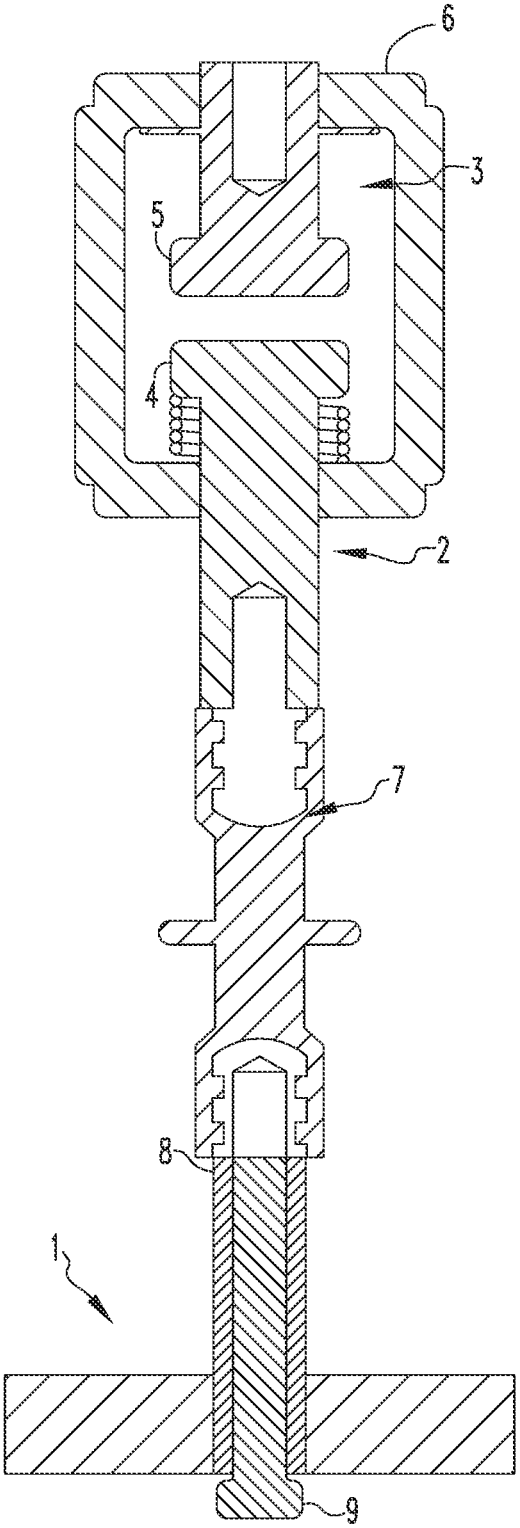

FIGS. 1A and 1B are diagrams depicting how a schematic actuator 1 for a circuit interrupter is connected to a driving mechanism to drive the separable contacts of the circuit interrupter between open and closed states, in accordance with an example embodiment of the disclosed concept. Schematic actuator 1 is coupled to an actuator shaft 8, with actuator shaft 8 coupled to a drive rod assembly 7, and drive rod assembly 7 coupled to a moving stem 2 of the circuit interrupter. Moving stem 2 comprises separable contact 4 and a fixed stem 3 comprises separable contact 5. Separable contacts 4, 5 are depicted as being enclosed within a vacuum housing 6, such as those used with vacuum-type circuit interrupters. However, it will be appreciated that schematic actuator 1 may be used with a non-vacuum-type circuit interrupter without departing from the scope of the disclosed concept. Fixed stem 3 is fixed relative to both vacuum housing 6 and an external electrical conductor, which is electrically interconnected with a power circuit supplying power to the circuit interrupter. It will be appreciated that the schematic actuator 1 and circuit interrupter components shown in FIGS. 1A and 1B would be connected to one phase of power in a three-phase power system, such that three identical arrangements of the assembly shown in FIGS. 1A and 1B would be used for a three-phase power system. Drive rod assembly 7 comprises an insulating cover that shields schematic actuator 1 from high voltage levels of the power circuit supplying power to the circuit interrupter. Drive rod assembly 7 also comprises a latch 9 which latches to a latching assembly (not shown) when separable contacts 4, 5 move to an open state in order to maintain the open state.

FIG. 1A depicts separable contacts 4, 5 in a closed state, which occurs when no fault condition is detected in the circuit interrupter. In the closed state of FIG. 1A, separable contacts 4, 5 are disposed to be in contact with one another such that electric current can flow between moving stem 2 and fixed stem 3. In contrast, FIG. 1B depicts separable contacts 4, 5 in an open state, which occurs when a trip unit (not shown) senses a fault condition in the circuit interrupter and trips schematic actuator 1 to cause drive rod assembly 7 to drive moving stem 2 and separable contact 4 away from fixed stem 3 and separable contact 5. Electric current is prevented from flowing between the moving stem 2 and fixed stem 3 when separable contacts 4, 5 are in an open state.

Figure 2B:
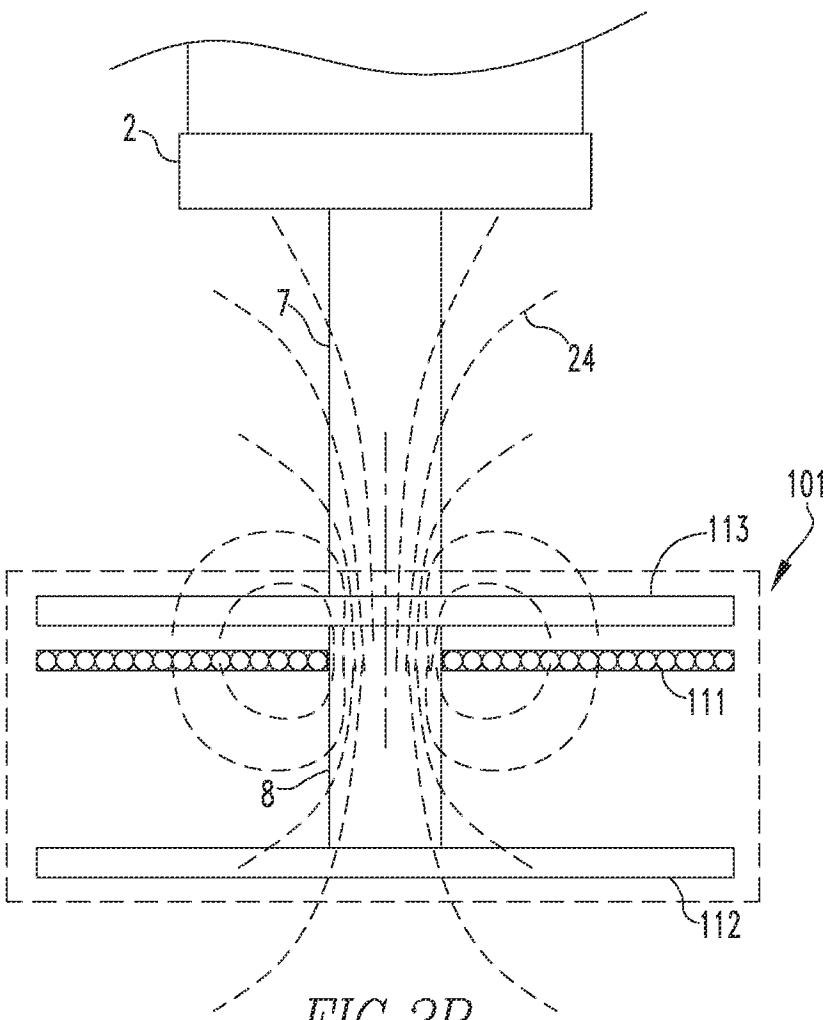
FIGS. 2A and 2B are diagrams of a coil actuator for a circuit interrupter including a conductive coil and two planar conductive members in accordance with an example embodiment of the disclosed concept.
Figure 2A:
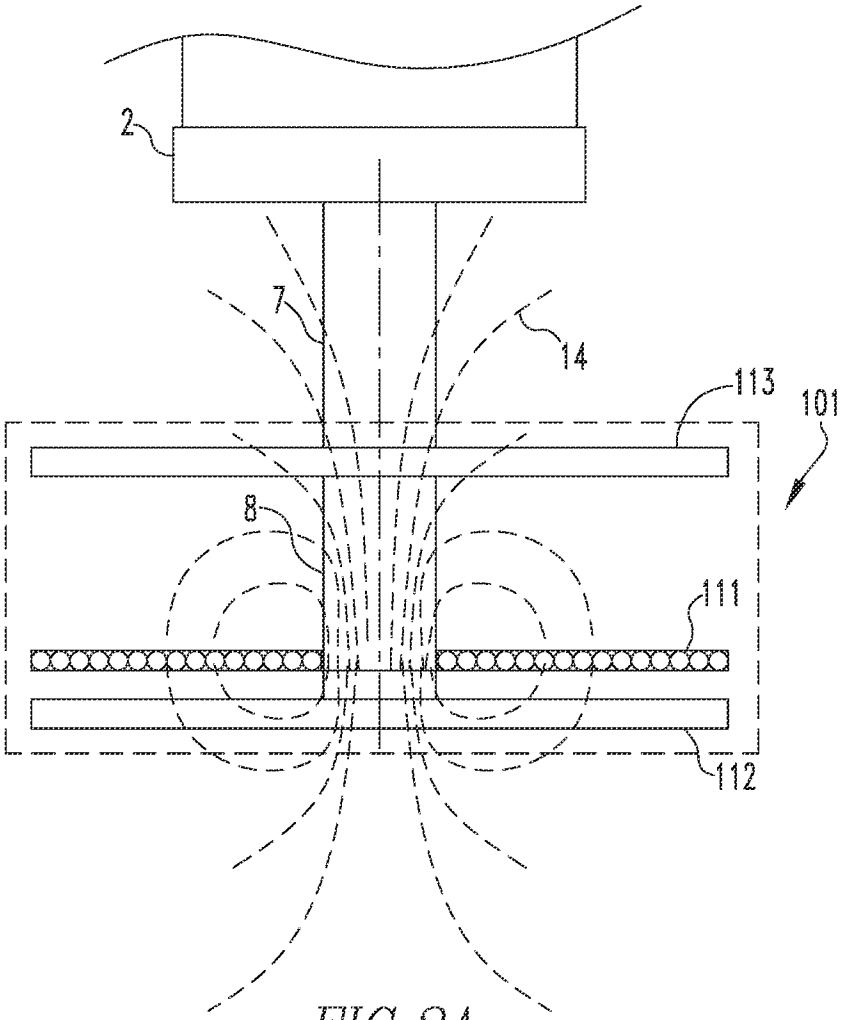
Figure 2C:
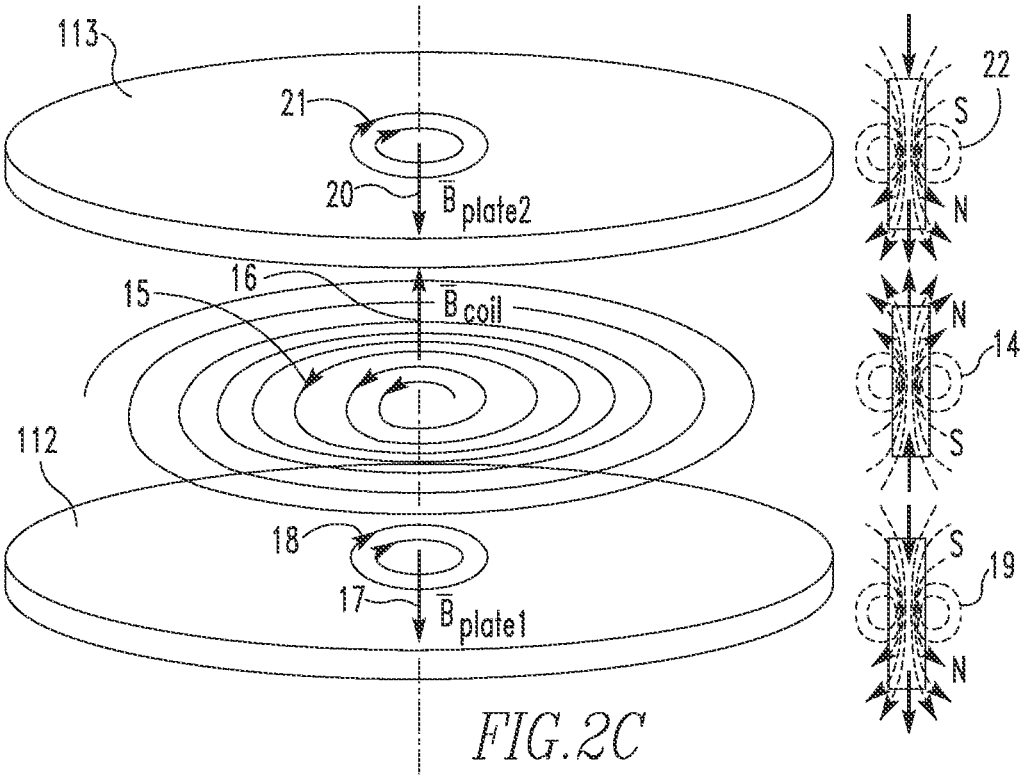
FIGS. 2C and 2D are diagrams of magnetic fields produced when current supplied to the coil actuator of FIGS. 2A and 2B is increased and decreased, respectively, in accordance with an example embodiment of the disclosed concept.
Figure 2D:
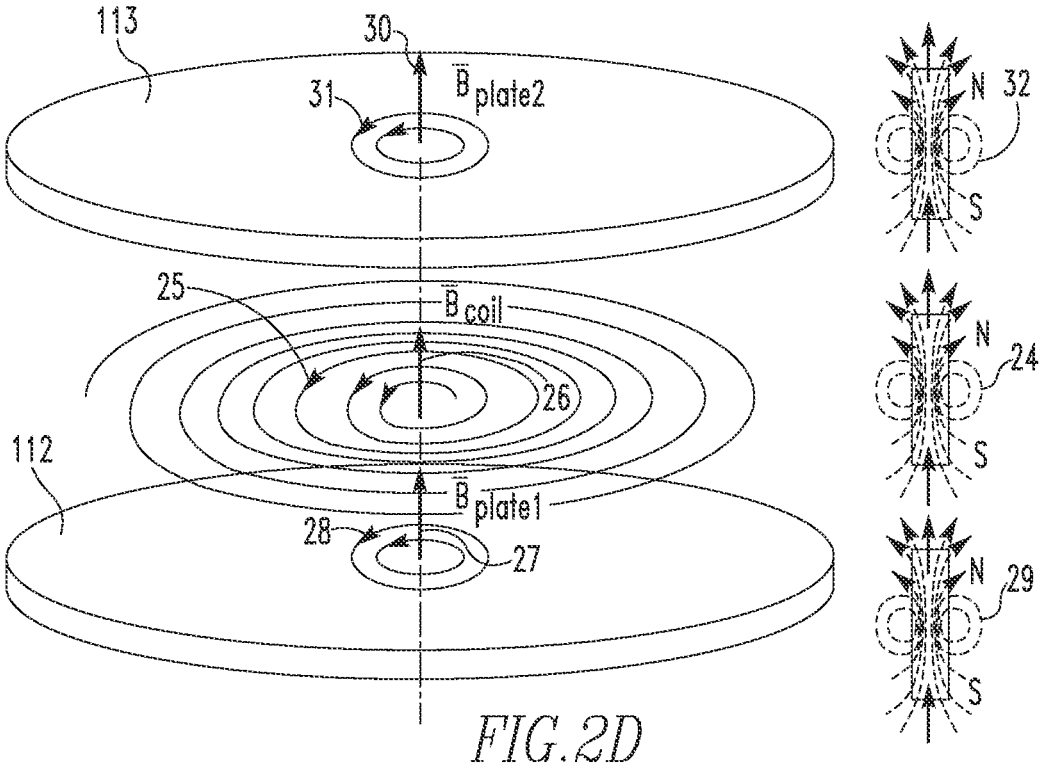

FIGS. 2A and 2B show cross-sectional views of a coil actuator 101 for a circuit interrupter. Coil actuator 101 is an example embodiment of schematic actuator 1 shown in FIGS. 1A and 1B and includes a conductive planar coil 111, a first planar conductive member 112, and a second planar conductive member 113. FIGS. 2C and 2D show partial isometric views of planar coil 111, first planar conductive member 112, and second planar conductive member 113 from FIGS. 2A and 2B.

Referring to FIGS. 2A and 2B, planar coil 111 is formed from a conductor wound into a coil that lies generally flat relative to a plane that is orthogonal to the viewing plane of FIGS. 2A and 2B. Planar coil 111 comprises a central opening through which actuator shaft 8 is disposed. First planar conductive member 112 and second planar conductive member 113 may be produced from any electrically conductive material, and comprise discs that lie generally flat relative to a plane that is orthogonal to the viewing plane of FIGS. 2A and 2B. First planar conductive member 112 and second planar conductive member 113 each comprise a central opening through which actuator shaft 8 is disposed. In one example embodiment of the disclosed concept, first planar conductive member 112 is produced from a different material than second planar conductive member 113. First planar conductive member 112 and second planar conductive member 113 are fixedly coupled to actuator shaft 8. Planar coil 111 is fixedly positioned relative to the space surrounding the circuit interrupter. Planar coil 111 is electrically connected to a current source (not shown) that can be selectively turned on and off by the trip unit of the circuit interrupter.

FIG. 2A depicts the disposition of coil actuator 101 when separable contacts 4, 5 are closed, as shown in FIG. 1A. In the closed state, the electromagnetic force required to move separable contacts 4, 5 from the closed state to the open state is generated by increasing the current $I_{coil}$ flowing through planar coil 111. FIG. 2C shows partial isometric views of planar coil 111, first planar conductive member 112, and second planar conductive member 113. FIG. 2C also depicts the flow of current $I_{coil}$, as well as the magnetic fields and eddy currents produced in first planar conductive member 112 and second planar conductive member 113 when current $I_{coil}$ is increasing. Current $I_{coil}$ flows in the direction indicated by arrow 15 in FIG. 2C.

When current $I_{coil}$ is increasing, the magnetic flux density $B_{coil,inc}$ of the magnetic field $H_{coil,inc}$ created by the flow of $I_{coil}$ through planar coil 111 also increases in the direction shown by arrow 16 in FIG. 2C, in accordance with the right hand rule. Magnetic field lines 14 in FIGS. 2A and 2C are representative of magnetic field $H_{coil,inc}$. In accordance with Lenz's law, eddy currents induced in first planar conductive member 112 due to a change in magnetic field $H_{coil,inc}$ will be oriented so as to oppose the change in flux of magnetic field $H_{coil,inc}$. Because the change in flux of magnetic field $H_{coil,inc}$ is an increase in flux oriented in the direction indicated by arrow 16 in FIG. 2C, the eddy currents induced in first planar conductive member 112 must flow in a direction that creates a magnetic field $H_{1,inc}$ with a magnetic flux oriented in the direction indicated by arrow 17 in FIG. 2C. As a result, the eddy currents induced in first planar conductive member 112 must flow in the direction indicated by arrow 18 in FIG. 2C, in accordance with the right hand rule. The magnetic field lines 19 in FIG. 2C are representative of magnetic field $H_{1,inc}$.

Also in accordance with Lenz's law, eddy currents induced in second planar conductive member 113 due to a change in magnetic field $H_{coil,inc}$ will be oriented so as to oppose the change in flux of magnetic field $H_{coil,inc}$. Because the change in flux of magnetic field $H_{coil,inc}$ is an increase in flux oriented in the direction indicated by arrow 16 in FIG. 2C, the eddy currents induced in second planar conductive member 113 must flow in a direction that creates a magnetic field $H_{2,inc}$ with a magnetic flux oriented in the direction indicated by arrow 20 in FIG. 2C. As a result, the eddy currents induced in second planar conductive member 113 must flow in the direction indicated by arrow 21 in FIG. 2C, in accordance with the right hand rule. The magnetic field lines 22 in FIG. 2C are representative of magnetic field $H_{2,inc}$.

The magnetic fields induced in planar coil 111 and first planar conductive member 112 are oriented in opposition to one another, as demonstrated by magnetic field lines 14 and 19 in FIG. 2C, causing first planar conductive member 112 to be repelled away from planar coil 111. The magnetic fields induced in planar coil 111 and second planar conductive member 113 are also oriented in opposition to one another, as demonstrated by magnetic field lines 14 and 22 in FIG. 2C, causing second planar conductive member 113 to also be repelled away from planar coil 111. However, in an example embodiment, second planar conductive member 113 has a higher resistivity than first planar conductive member 112. The difference in resistivity between second planar conductive member 113 and first planar conductive member 112 could achieved either by producing second planar conductive member 113 and first planar conductive member 112 from different materials, coating either or both of second planar conductive member 113 and first planar conductive member 112 with a material having a resistivity different from the other planar conductive member, or producing second planar conductive member 113 and first planar conductive member 112 with differing surface area sizes and/or cross-section properties from one another. As a result of second planar conductive member 113 having a relatively higher resistivity than first planar conductive member 112, the magnitude of the repulsion between magnetic field $H_{1,inc}$ and magnetic field $H_{coil,inc}$ is greater than the repulsion between magnetic field $H_{2,inc}$ and $H_{coil,inc}$, and the net electromagnetic force created by the repulsion between these magnetic fields causes drive rod assembly 7 to drive moving stem 2 and separable contact 4 away from fixed stem 3 and separable contact 5 such that separable contacts 4, 5 move from a closed state to an open state.

FIG. 2B depicts the disposition of coil actuator 101 when separable contacts 4, 5 are open, as shown in FIG. 1B. In the open state, the electromagnetic force required to move separable contacts 4, 5 from the open state to the closed state is generated by decreasing the current $I_{coil}$ flowing through planar coil 111. FIG. 2D shows partial isometric views of planar coil 111, first planar conductive member 112, and second planar conductive member 113. FIG. 2D also depicts the flow of current $I_{coil}$, as well as the magnetic fields and eddy currents produced in first planar conductive member 112 and second planar conductive member 113 when current $I_{coil}$ is decreasing. Current $I_{coil}$ flows in the direction indicated by arrow 25 in FIG. 2D.

When current $I_{coil}$ is decreasing, the magnetic flux density $B_{coil,dec}$ of the magnetic field $H_{coil,dec}$ created by the flow of $I_{coil}$ through planar coil 111 also decreases in the direction shown by arrow 26 in FIG. 2D, in accordance with the right hand rule. Magnetic field lines 24 in FIGS. 2B and 2D are representative of magnetic field $H_{coil,dec}$. In accordance with Lenz's law, eddy currents induced in first planar conductive member 112 due to a change in magnetic field $H_{coil,dec}$ will be oriented so as to oppose the change in flux of magnetic field $H_{coil,dec}$. Because the change in flux of magnetic field $H_{coil,dec}$ is a decrease in flux oriented in the direction indicated by arrow 26 in FIG. 2D, the eddy currents induced in first planar conductive member 112 must flow in a direction that creates a magnetic field $H_{1,dec}$ with a magnetic flux oriented in the direction indicated by arrow 27 in FIG. 2D. As a result, the eddy currents induced in first planar conductive member 112 must flow in the direction indicated by arrow 28 in FIG. 2D, in accordance with the right hand rule. The magnetic field lines 29 in FIG. 2D are representative of magnetic field $H_{1,dec}$.

Also in accordance with Lenz's law, eddy currents induced in second planar conductive member 113 due to a change in magnetic field $H_{coil,dec}$ will be oriented so as to oppose the change in flux of magnetic field $H_{coil,dec}$. Because the change in flux of magnetic field $H_{coil,dec}$ is a decrease in flux oriented in the direction indicated by arrow 26 in FIG. 2D, the eddy currents induced in second planar conductive member 113 must flow in a direction that creates a magnetic field $H_{2,dec}$ with a magnetic flux oriented in the direction indicated by arrow 30 in FIG. 2D. As a result, the eddy currents induced in second planar conductive member 113 must flow in the direction indicated by arrow 31 in FIG. 2D, in accordance with the right hand rule. The magnetic field lines 32 in FIG. 2D are representative of magnetic field $H_{2,dec}$.

The magnetic fields induced in planar coil 111 and first planar conductive member 112 are oriented in alignment with one another, as demonstrated by magnetic field lines 24 and 29 in FIG. 2D, causing first planar conductive member 112 to be attracted toward planar coil 111. The magnetic fields induced in planar coil 111 and second planar conductive member 113 are also oriented in alignment with one another, as demonstrated by magnetic field lines 24 and 32 in FIG. 2D, causing second planar conductive member 113 to also be attracted toward planar coil 111. The net electromagnetic force resulting from the cumulative attraction between magnetic field $H_{1,dec}$ and magnetic field $H_{coil,dec}$ and between magnetic field $H_{2,dec}$ and $H_{coil,dec}$ causes drive rod assembly 7 to drive moving stem 2 and separable contact 4 toward fixed stem 3 and separable contact 5 such that separable contacts 4, 5 move from an open state to a closed state.

Coil actuators employing one coil, such as planar coil 111, and one conductive member, such as first planar conductive member 112, are commonly referred to as Thomson coil actuators. The use of two conductive members in the present disclosure, first planar conductive member 112 and second planar conductive member 113, represents an improvement over existing Thomson coil actuator technology, as each of the two conductive members produces a damping effect at different times. Specifically, the inclusion of second planar conductive member 113 dampens the end of an opening stroke, particularly if second planar conductive member 113 has a relatively higher resistivity than first planar conductive member 112, due to the orientation and magnitude of magnetic field $H_{2,inc}$ induced in second planar conductive member 113 and the cumulative effects of $H_{2,inc}$ and $H_{1,inc}$ when current $I_{coil}$ is increasing. The damping effect produced by second planar conductive member 113 in an opening stroke enables coil actuator 101 to be designed such that first planar conductive member 112 produces maximum opening stroke acceleration while minimizing the wear and tear to the components of the overall circuit interrupter assembly that would otherwise result from the force of the opening stroke.

Figure 3B:
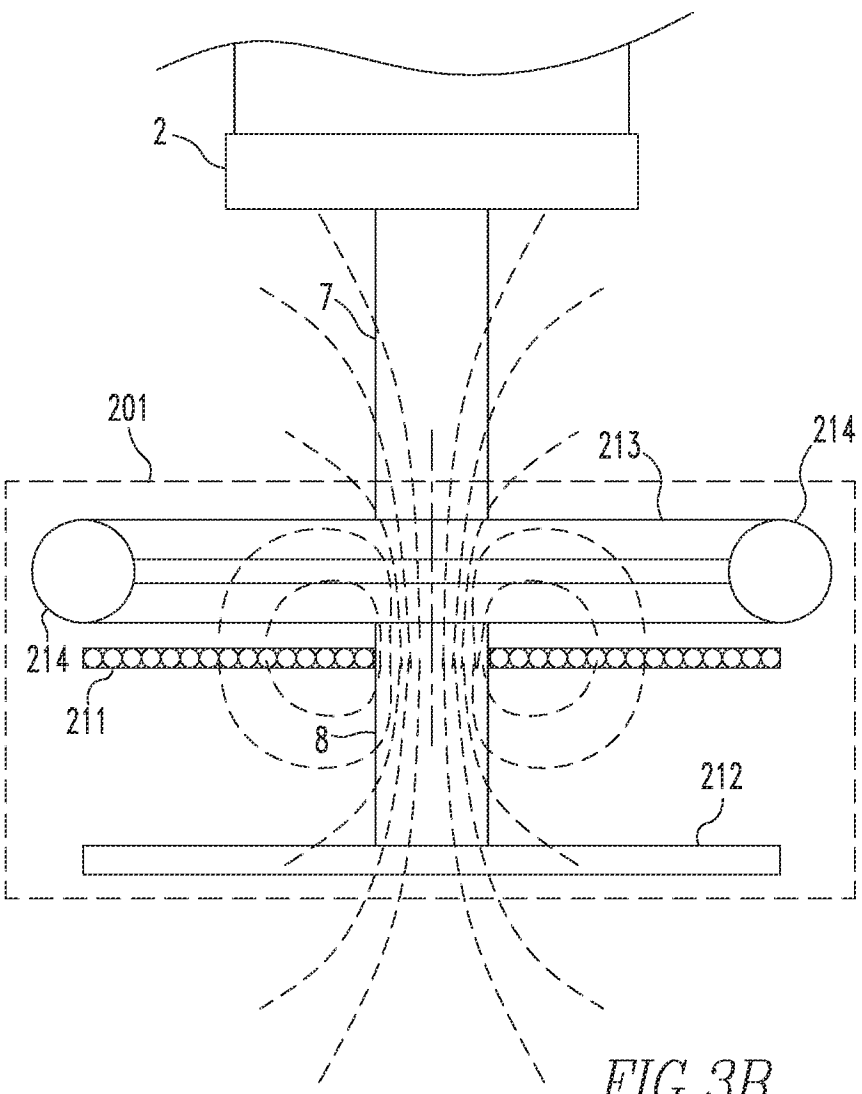
FIGS. 3A and 3B are diagrams of a coil actuator for a circuit interrupter including a conductive coil, a planar conductive member, and a toroidal conductive member in accordance with an example embodiment of the disclosed concept.
Figure 3A:
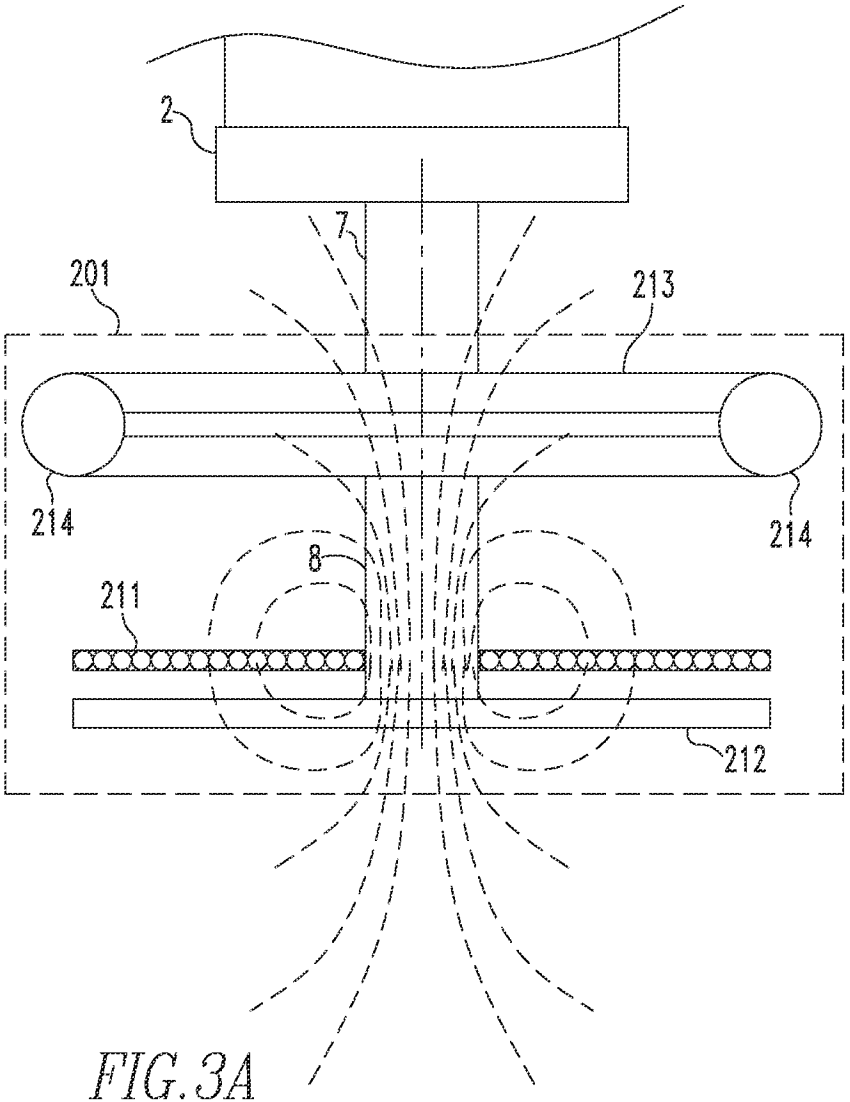
Figure 3C:
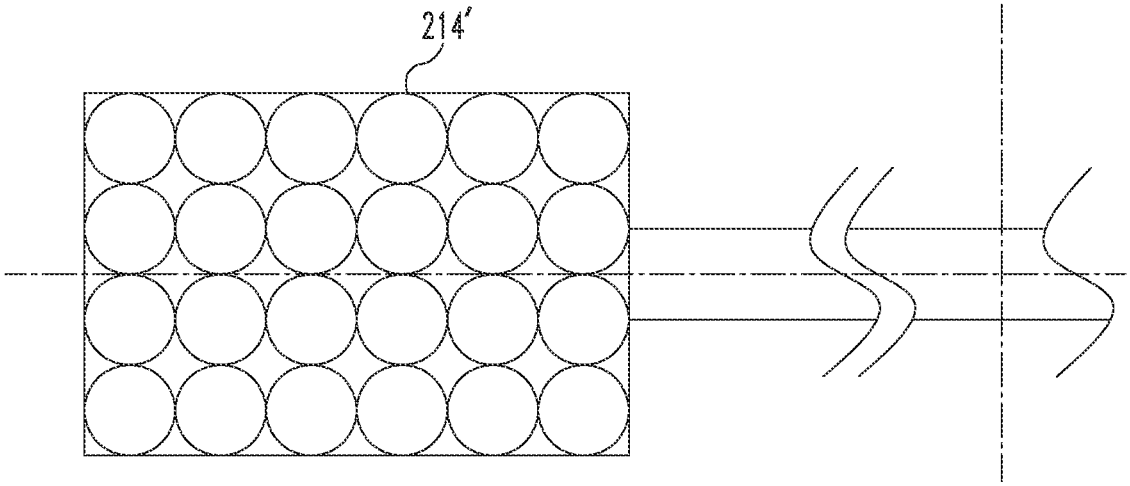
FIG. 3C shows an example of a cross-sectional view of the toroidal conductive member shown in FIGS. 3A and 3B in accordance with an example embodiment of the disclosed concept.
Figure 3D:
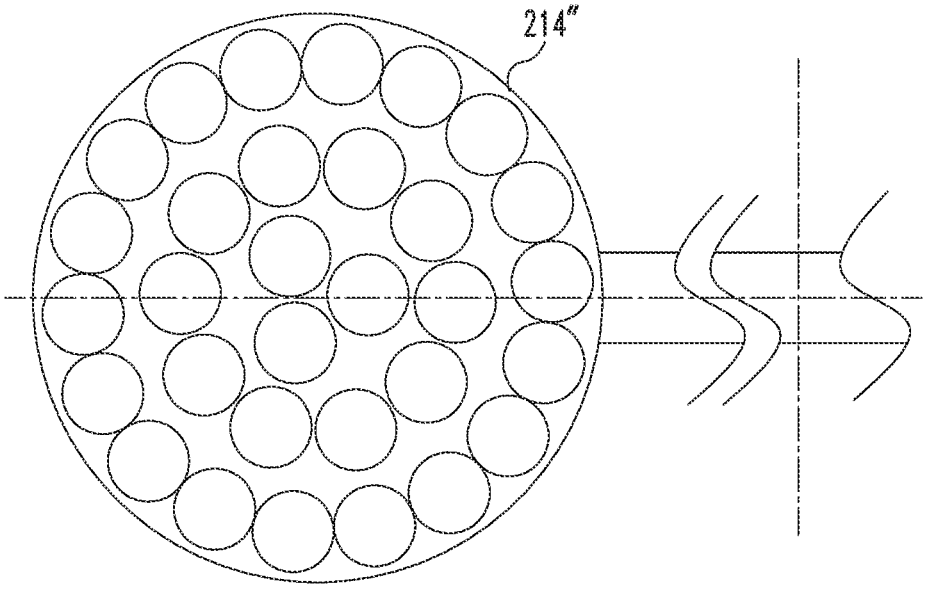
FIG. 3D shows another example of a cross-sectional view of the toroidal conductive member shown in FIGS. 3A and 3B in accordance with an example embodiment of the disclosed concept.

FIGS. 3A and 3B show cross-sectional views of a coil actuator 201 for a circuit interrupter. Coil actuator 201 is another example embodiment of schematic actuator 1 shown in FIGS. 1A and 1B and includes a conductive planar coil 211, a planar conductive member 212, and a toroidal conductive member 213. In FIGS. 3A and 3B, planar coil 211 is shown in cross-sectional view and toroidal conductive member 213 is shown in partial cross-sectional view. FIGS. 3C and 3D depict example cross-sectional views of toroidal conductive member 213 from FIGS. 3A and 3B.

Planar coil 211 is formed from a conductor wound into a coil that lies generally flat relative to a plane that is orthogonal to the viewing plane of FIGS. 3A and 3B, and comprises a central opening through which actuator shaft 8 is disposed. Planar conductive member 212 may be produced from any electrically conductive material, and comprises a disc that lies generally flat relative to a plane that is orthogonal to the viewing plane of FIGS. 2A and 2B with a central opening through which actuator shaft 8 is disposed. Toroidal conductive member 213 resembles a toroid and may be formed from any electrically conductive material. The opening in the center of toroidal conductive member 213 containing its axis of revolution lies in a plane that is orthogonal to the viewing plane of FIGS. 2A and 2B. Actuator shaft 8 is disposed through the same opening in the center of toroidal conductive member 213. Planar conductive member 212 and toroidal conductive member 213 are fixedly coupled to actuator shaft 8. Planar coil 211 is fixedly positioned relative to the space surrounding the circuit interrupter.

FIG. 3A depicts the disposition of coil actuator 201 when separable contacts 4, 5 are closed, as shown in FIG. 1A. In the closed state, the electromagnetic force required to move separable contacts 4, 5 from the closed state to the open state is generated by increasing the current $I_{coil}$ flowing through planar coil 211, similarly to how increasing current $I_{coil}$ through planar coil 111 of FIG. 2A was explained to move separable contacts 4, 5 from the closed state to the open state in the description of FIGS. 2A and 2C above. FIG. 3B depicts the disposition of coil actuator 201 when separable contacts 4, 5 are open, as shown in FIG. 1B. In the open state, the electromagnetic force required to move separable contacts 4, 5 from the open state to the closed state is generated by decreasing the current $I_{coil}$ flowing through planar coil 211, similarly to how decreasing current $I_{coil}$ through planar coil 111 of FIG. 2B was explained to move separable contacts 4, 5 from the open state to the closed state in the description of FIGS. 2B and 2D above.

Coil actuator 201 operates similarly to coil actuator 101 with respect to using increasing and decreasing current $I_{coil}$ through planar coil 211 to cause actuator shaft 8 to cause drive rod assembly 7 to open and close separable contacts 4, 5. Employing toroidal conductive member 213 in coil actuator 201 in lieu of a second planar conductive member such as that used in coil actuator 101 has the effect of inducing eddy currents and a magnetic field differing in orientation from those induced in second planar conductive member 113 to achieve adjustments to the forces needed to open and close separable contacts 4, 5 that may be desired by a user of the circuit interrupter. In addition, FIGS. 3C and 3D depict varying cross-sections 214 that toroidal conductive member 213 may have. In one example embodiment of the disclosed concept, toroidal conductive member 213 has a rectangular cross-section, such as rectangular cross-section 214' shown in FIG. 3C. In another example embodiment of the disclosed concept, toroidal conductive member 213 has a circular cross-section, such as circular cross-section 214" shown in FIG. 3D. However, it will be appreciated that toroidal conductive member may have a cross-section of any shape without departing from the scope of the disclosed concept. Adjusting cross section 214 of toroidal conductive member 213 has the effect of adjusting the eddy currents and magnetic field induced in toroidal conductive member 213 to achieve adjustments to the forces needed to open and close separable contacts 4, 5 that may be desired by a user of the circuit interrupter.

Figure 4B:
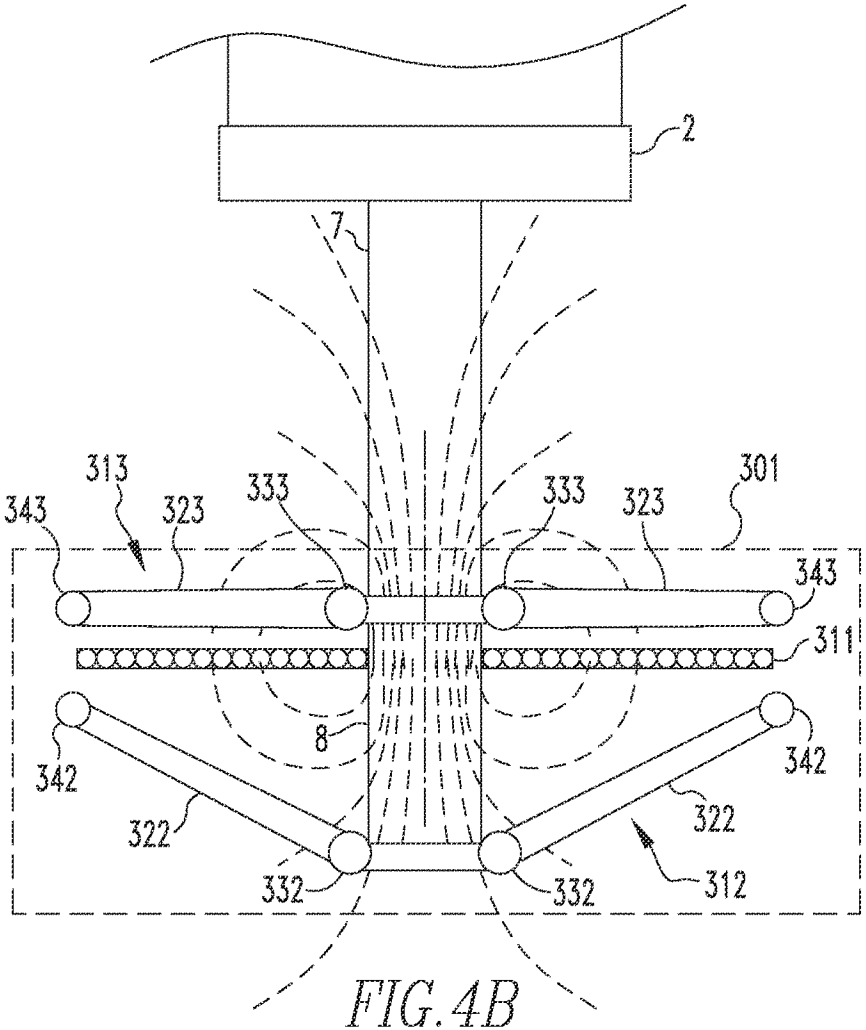
FIGS. 4A and 4B are diagrams of a coil actuator for a circuit interrupter including a conductive coil and two hinged conductive members in accordance with an example embodiment of the disclosed concept.
Figure 4A:
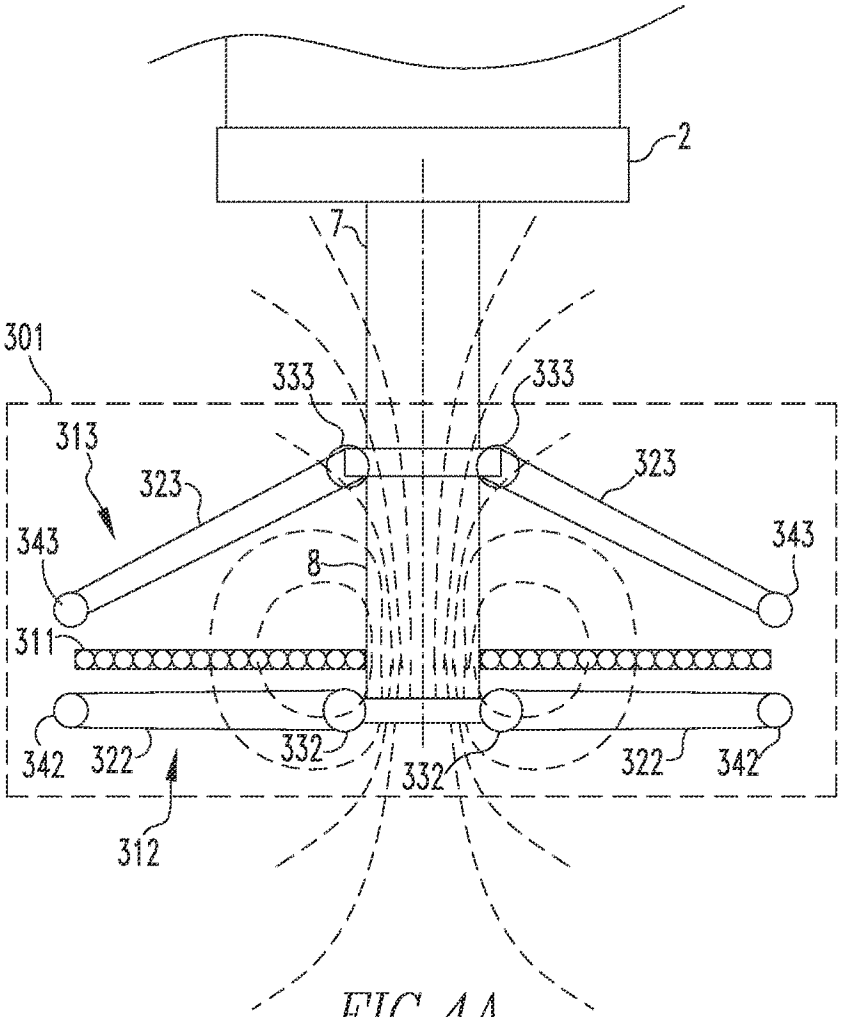

FIGS. 4A and 4B show cross-sectional views of a coil actuator 301 for a circuit interrupter. Coil actuator 301 is another example embodiment of schematic actuator 1 shown in FIGS. 1A and 1B and includes a conductive planar coil 311, a first hinged conductive member 312, and a second hinged conductive member 313. Planar coil 311 is formed from a conductor wound into a coil that lies generally flat relative to a plane that is orthogonal to the viewing plane of FIGS. 4A and 4B. Planar coil 311 may be formed from any electrically conductive material. First hinged conductive member 312 comprises a plurality of skirt portions 322 which may be produced from any electrically conductive material. Each of the plurality of skirt portions 322 comprises an interior end and an exterior end. The interior end of each skirt portion 322 is coupled to actuator shaft 8 by a movable hinge 332. For any given skirt portion 322, fixed hinges 342 couple the exterior end of that skirt portion 322 to the exterior ends of the skirt portions 322 adjacent to that skirt portion 322. Second hinged conductive member 313 comprises a plurality of skirt portions 323 which may be produced from any electrically conductive material. Each of the plurality of skirt portions 323 comprises an interior end and an exterior end. The interior end of each skirt portion 322 is coupled to actuator shaft 8 by a movable hinge 333. For any given skirt portion 323, fixed hinges 343 couple the exterior end of that skirt portion 323 to the exterior ends of the skirt portions 323 adjacent to that skirt portion 323. Coupling the interior ends of skirt portions 322 and 323 to actuator shaft 8 while coupling the exterior ends to the exterior ends of adjacent skirt portions allows skirt portions 322 and 323 to pivot between sloped and flat positions, as depicted in FIGS. 4A and 4B and described in more detail below.

FIG. 4A depicts the disposition of coil actuator 301 when separable contacts 4, 5 are closed, as shown in FIG. 1A. When separable contacts 4, 5 are closed, skirt portions 322 of first hinged conductive member 312 lie generally flat relative to a plane that is orthogonal to the viewing plane of FIG. 4A, while skirt portions 323 of second hinged conductive member 313 are disposed in the sloped position depicted in FIG. 4A. FIG. 4B depicts the disposition of coil actuator 301 when separable contacts 4, 5 are open, as shown in FIG. 1B. When separable contacts 4, 5 are closed, skirt portions 323 of second hinged conductive member 313 lie generally flat relative to a plane that is orthogonal to the viewing plane of FIG. 4B, while skirt portions 322 of first hinged conductive member 312 are disposed in the sloped position depicted in FIG. 4B. Skirt portions 322, 323 may be produced as thin, flexible panels arranged in a cascading arrangement similar to the individual panels of an airport baggage carousel. Such an arrangement allows skirt portions 322, 323 to move between flat and sloped dispositions without creating any gaps in the overall structure of hinged conductive members 312, 313. Employing hinged conductive members 312, 313 in coil actuator 301 in lieu of planar conductive members 112, 113 such as those used in coil actuator 101 has the effect of inducing eddy currents and magnetic fields differing in orientation from those induced in planar conductive members 112, 113 to achieve adjustments to the forces needed to open and close separable contacts 4, 5 that may be desired by a user of the circuit interrupter, as discussed below.

Coil actuator 301 operates similarly to coil actuator 101 with respect to using increasing and decreasing current $I_{coil}$ through planar coil 311 to cause actuator shaft 8 to cause drive rod assembly 7 to open and close separable contacts 4, 5. An opening stroke of the circuit interrupter occurs when separable contacts 4, 5 move from a closed state, as in FIG. 4A, to an open state, as in FIG. 4B. The change in disposition of first hinged conductive member 312 from a generally flat disposition at the beginning of an opening stroke to the sloped disposition at the end of an opening stroke enables the greatest possible magnitude magnetic field to be induced in first hinged conductive member 312 at the beginning of an opening stroke while damping the opening force at the end of the opening stroke to minimize contact force and wear and tear to other components of the overall circuit interrupter assembly that could otherwise result. When $I_{coil}$ is increasing through planar coil 311, a magnetic field similar to $H_{coil,inc}$ described with respect to FIGS. 2A and 2C is created. Accordingly, a magnetic field $H_{1,inc}$ as described with respect to FIG. 2C is also created. Magnetic field intensity is directly proportional to magnetic flux, and the maximum magnetic flux is encountered in a plane normal to the source of the magnetic field, as shown in Equation (1):

$$\Phi_B = B \cdot A = |B| A \cos(\theta) \quad (1)$$

Where $\Phi_B$ is magnetic flux, B is the magnetic flux density, A is the area of a surface encountering the magnetic field, and θ is the angle between a plane normal to the source of the magnetic field and the surface encountering the magnetic field. When skirt portions 322 of first hinged conductive member 312 are in the flat disposition at the beginning of an opening stroke as shown in FIG. 4A, θ=0, cos (θ)=1 and $\Phi_B$ is at its maximum value. When $\Phi_B$ is at its maximum value, the repulsive force between the magnetic field of planar coil 311 and the magnetic field induced in first hinged conductive member 312 is also at a maximum, and the electromagnetic force for opening separable contacts 4, 5 is at a maximum. When skirt portions 322 of first hinged conductive member 312 are in a sloped disposition at the end of an opening stroke as shown in FIG. 4B, θ≠0, cos (θ)<1 and $\Phi_B$ is below its maximum value. When $\Phi_B$ is below its maximum value, the repulsive force between the magnetic field of planar coil 311 and the magnetic field induced in first hinged conductive member 312 is also below its maximum value, leading to a decrease in the electromagnetic force for opening separable contacts 4, 5 that results in damping of the opening force.

A closing stroke of the circuit interrupter occurs when separable contacts 4, 5 move from an open state, as in FIG. 4B, to a closed state, as in FIG. 4A. The change in disposition of second hinged conductive member 313 from a generally flat disposition at the beginning of a closed stroke to the sloped disposition at the end of a closing stroke enables the strongest possible magnetic field to be induced in second hinged conductive member 313 at the beginning of a closing stroke while damping the closing force at the end of the closing stroke to minimize contact force and wear and tear that may result from separable contacts 4, 5 coming into contact. When $I_{coil}$ is decreasing through planar coil 311, a magnetic field similar to $H_{coil,dec}$, as described with respect to FIGS. 2B and 2D is created. Accordingly, a magnetic field $H_{2,dec}$ as described with respect to FIG. 2D is also created. Referring to Equation (1), when skirt portions 323 of second hinged conductive member 313 are in the flat disposition at the beginning of a closing stroke as shown in FIG. 4B, θ=0, cos (θ)=1 and $\Phi_B$ is at its maximum value. When $\Phi_B$ is at its maximum value, the repulsive force between the magnetic field of planar coil 311 and the magnetic field induced in second hinged conductive member 313 is also at a maximum, and the electromagnetic force for closing separable contacts 4, 5 is at a maximum. When skirt portions 323 of second hinged conductive member 313 are in a sloped disposition at the end of an opening stroke as shown in FIG. 4A, θ≠0, cos (θ)<1 and $\Phi_B$ is below its maximum value. When $\Phi_B$ is below its maximum value, the repulsive force between the magnetic field of planar coil 311 and the magnetic field induced in second hinged conductive member 313 is also below its maximum value, leading to a decrease in the electromagnetic force for closing separable contacts 4, 5 that results in damping of the closing force. The damping of the closing force minimizes wear and tear to other components of the overall circuit interrupter assembly that could otherwise result.

The embodiment of FIGS. 4A and 4B represents an improvement over existing coil actuator technology in at least two ways: (1) the hinged design of first hinged conductive member 312 enables the opening stroke of coil actuator 301 to be faster than the opening strokes of Thomson coil actuators using traditional planar conductive members, and (2) the hinged design of second hinged conductive member 313 performs a damping function that eliminates the need for a mechanical damper, which is typically included in Thomson coil actuators. While FIGS. 4A and 4B depict both conductive members of coil actuator 301 being hinged, it will be appreciated that an example embodiment of schematic actuator 1 from FIGS. 1A and 1B could employ only one hinged conductive member while employing a second conductive member that is planar without departing from the scope of the disclosed concept. For example, if damping at the end of the closing stroke is desired but increasing the speed of the opening stroke is not a priority, a coil actuator employing a second hinged conductive member 313 from FIGS. 4A-4B in combination with a first planar conductive member 112 from FIGS. 2A-2B along with a planar coil could be implemented. In another example, if increasing the speed of the opening stroke is desired and damping of the closing stroke is not a priority, a coil actuator employing a first hinged conductive member 312 from FIGS. 4A-4B in combination with a second planar conductive member 113 from FIGS. 2A-2B along with a planar coil could be implemented.

Figure 5:
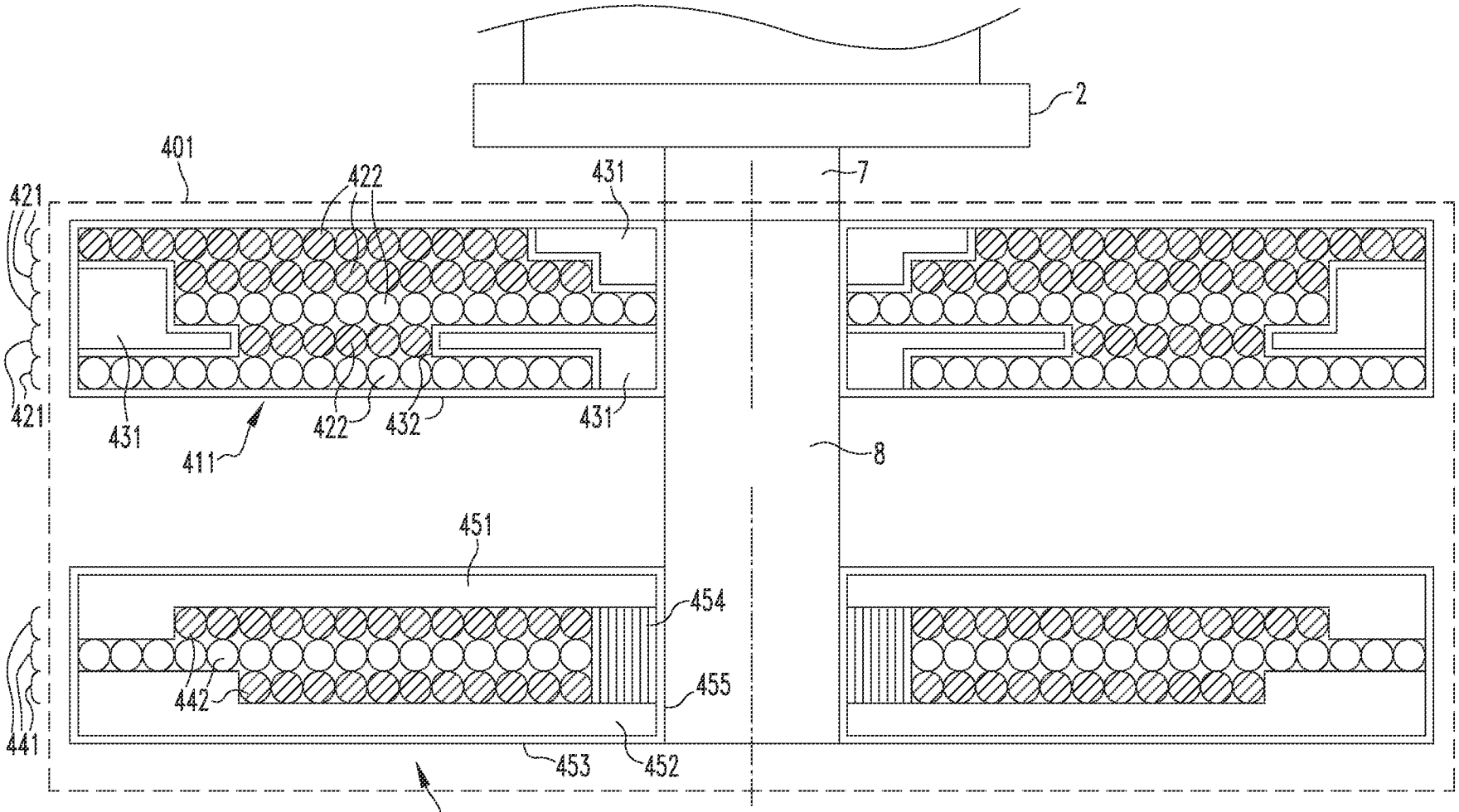
FIG. 5 is a diagram of a coil actuator for a circuit interrupter including a multilayered conductive coil and a composite conductive member in accordance with an example embodiment of the disclosed concept.

FIG. 5 shows cross-sectional views of a coil actuator 401 for a circuit interrupter. Coil actuator 401 is yet another example embodiment of schematic actuator 1 shown in FIGS. 1A and 1B and includes a multilayer coil 411 and a composite conductive member 412. Multilayer coil 411 comprises a central opening through which actuator shaft is disposed and is fixedly positioned relative to the space surrounding the circuit interrupter. Composite conductive member 412 comprises a central opening through which actuator shaft 8 is disposed and is fixedly coupled to actuator shaft 8 via joints 455. Joints 455 may be constructed as threaded joints if facilitating removal of composite conductive member 412 from actuator shaft 8 for maintenance or other purposes is desired. However, it will be appreciated that joints 455 may be constructed as welded joints or any other types of joints without departing from the scope of the disclosed concept.

Multilayer coil 411 comprises a plurality of coil layers 421, inserts 431 of ferromagnetic material and an insulating layer/case 432. Each coil layer 421 is formed from a distinct conductor wire 422 wound into a coil that lies generally flat relative to a plane that is orthogonal to the viewing plane of FIG. 5. Each coil layer 421 may be formed from a distinct conductor material, have a distinct conductor wire diameter, have a distinct number of coil turns, and have a distinct coil diameter with respect to other coil layers 421. Each coil layer 421 may be controlled, charged, and discharged by a processor (not shown) independently from every other coil layer 421. Insulating layer/case 432 may be produced from any insulating material. Inserts 431 may be produced from any ferromagnetic material to produce desired electromagnetic latching effects. While multilayer coil 411 is depicted as comprising inserts 431 in FIG. 5, it will be appreciated that inserts 431 may be omitted without departing from the scope of the disclosed concept.

Composite conductive member 412 comprises at least one ferromagnetic insert 451, and an insulating case 453. Composite conductive member 412 may additionally comprise a plurality of conductor layers 441, however, conductor layers 441 may be omitted without departing from the scope of the disclosed concept. Each conductor layer 441 is formed from a distinct conductor wire 442 wound into a coil that lies generally flat relative to a plane that is orthogonal to the viewing plane of FIG. 5. Each conductor layer 441 may be formed from a distinct conductor material, have a distinct conductor wire diameter, have a distinct number of coil turns, and have a distinct coil diameter with respect to other conductor layers 441. Each conductor layer 441 may be controlled by a processor (not shown) independently from every other conductor layer 441. Insulating case 453 may be produced from any insulating material. Ferromagnetic insert 451 may be produced from any ferromagnetic material, and is placed directly adjacent to and underneath the top side of insulating case 453 to facilitate the inducement of eddy currents by magnetic fields generated by currents flowing through coil layers 421. A permanent magnet 452 may be included to control the orientation and magnitude of any magnetic fields induced in composite conductive member 412 when current flows through any of the conductor layers 441 or coil layers 421.

To further adjust any magnetic fields induced in composite conductive member 412, composite conductive member 412 may also include a capacitor and dielectric plate arrangement 454 including a number of capacitors and dielectric plates. The capacitors in arrangement 454 can be electrically connected to one or more of the conductor layers 441 and may be used to hold charge and provide current flow to generate magnetic fields and electromagnetic forces within composite conductive member 412, while the dielectric plates in arrangement 454 provide a strong insulating barrier between composite conductive member 412 and actuator shaft 8. Permanent magnet 452 and arrangement 454 may add utility in some applications of the coil actuator 401 while proving unnecessary in others, and it will be appreciated that either permanent magnet 452 or arrangement 454 or both may be omitted from composite conductive member 412 without departing from the scope of the disclosed concept.

Coil actuator 401 operates based on the same principles as coil actuator 101 with respect to supply increasing and decreasing currents $I_{coil}$ to the coil layers 421 of multilayer coil 411 to induce eddy currents in composite conductive member 412 in order to cause actuator shaft 8 and drive rod assembly 7 to open and close separable contacts 4, 5. However, the inclusion of multiple coil layers 421 instead of a single coil, the ability to supply current to each coil layer 421 independently of every other coil layer 421, and the variance in the physical dimensions among the coil layers 421 allows multilayer coil 411 to output more nuanced current profiles. In addition, disposing conductor layers 441 adjacent to ferromagnetic insert 451 allows composite conductive member 412 to generate its own magnetic fields independently of multilayer coil 411 to enhance or dampen the effects of the magnetic fields generated by eddy currents induced in ferromagnetic insert 451 by coil layers 421.

In one non-limiting example, if separable contacts 4, 5 are closed and currents $I_{coil}$ flowing through multilayer coil 411 generate a repulsion force by inducing eddy currents in ferromagnetic insert 451 to drive composite conductive member 412 away from multilayer coil 411, current may be supplied to any or all of the conductor layers 441 to produce a magnetic field to oppose the repulsion force and dampen the velocity of the opening stroke. Similarly, in another non-limiting example, if separable contacts 4, 5 are open and currents $I_{coil}$ flowing through multilayer coil 411 generate an attraction force by inducing eddy currents in ferromagnetic insert 451 to drive composite coil 412 toward multilayer coil 411, current may be supplied to any or all of the conductor layers 441 to produce a magnetic field to oppose the attraction force and dampen the velocity of the closing stroke.

It will be appreciated that multilayer coil 411 could be fixedly coupled to actuator shaft 8 instead of being fixedly positioned relative to the space surrounding the circuit interrupter while composite conductive member 412 could be fixedly positioned relative to the space surrounding the circuit interrupter instead of being fixedly coupled to actuator shaft 8 without departing from the scope of the disclosed concept, provided that any wires used to supply current to multilayer coil 411 are sufficiently durable and flexible to withstand movement of the multilayer coil 411 as the actuator shaft 8 moves during opening and closing strokes.

Figure 6A:
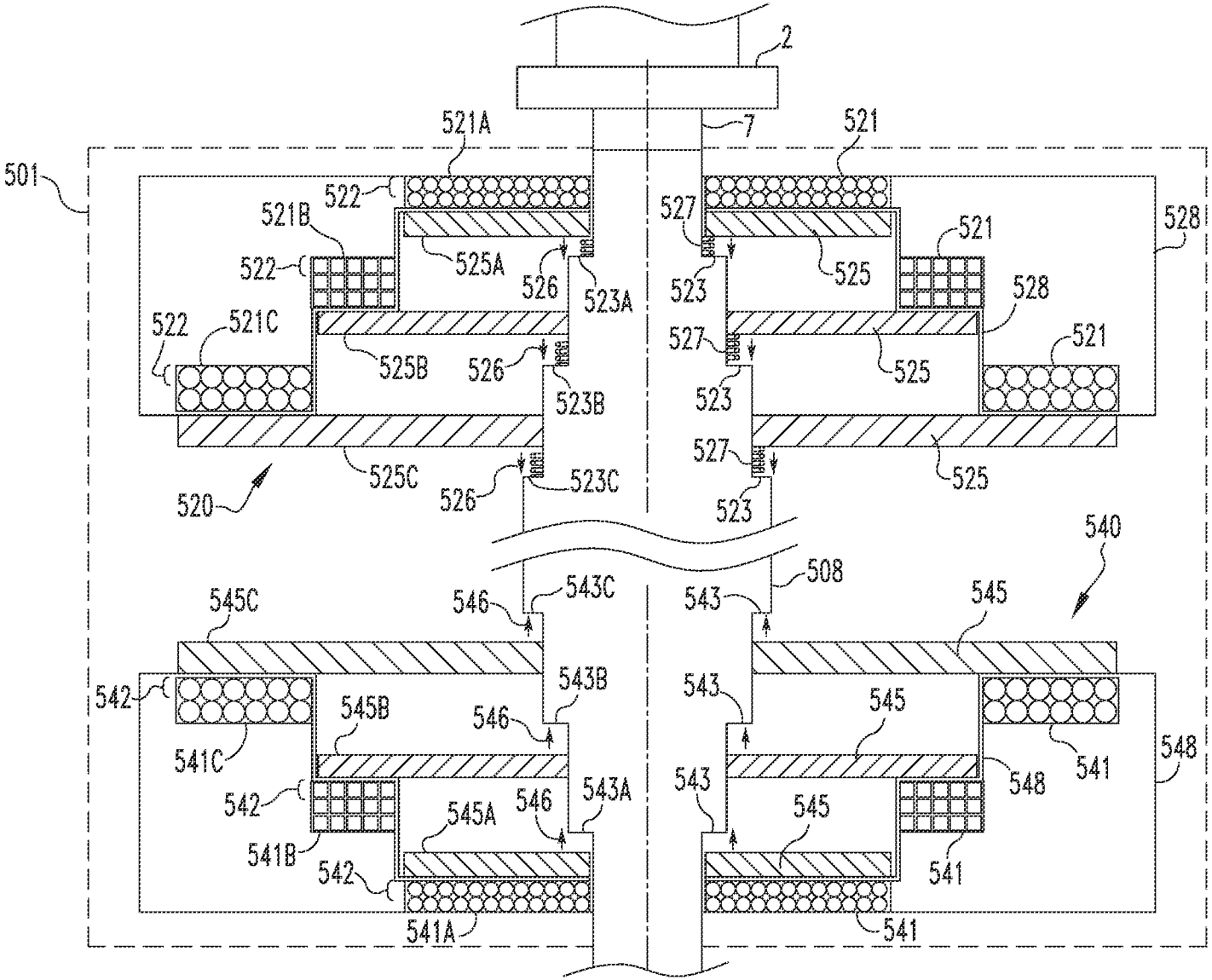
FIGS. 6A-6D are diagrams of a coil actuator for a circuit interrupter including two arrangements of alternating conductive coils and conductive members in accordance with an example embodiment of the disclosed concept.
Figure 6B:
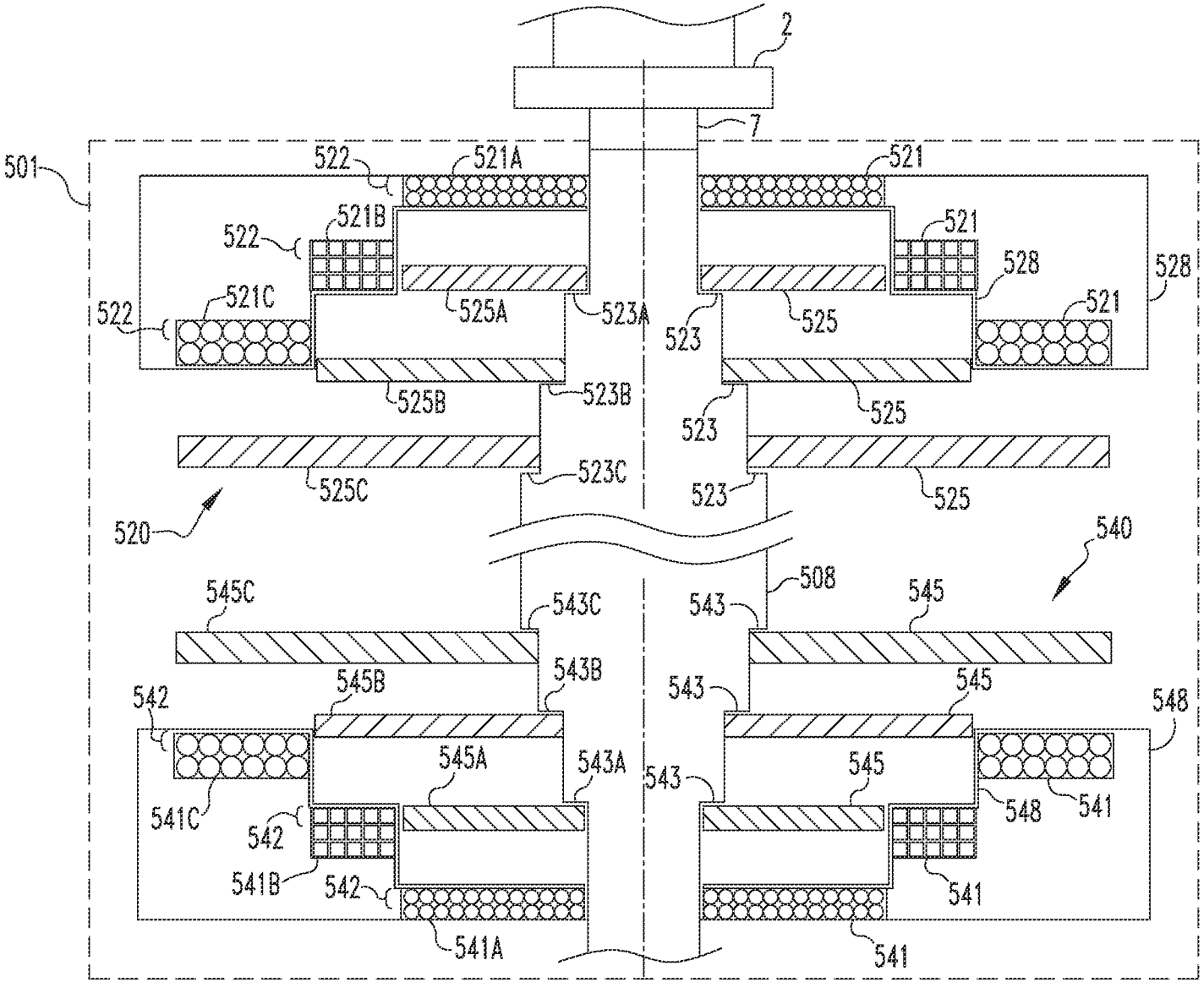

FIGS. 6A and 6B show cross-sectional views of a coil actuator 501 for a circuit interrupter. Coil actuator 501 is yet another example embodiment of schematic actuator 1 shown in FIGS. 1A and 1B and includes a first telescoping arrangement 520, a second telescoping arrangement 540, and a telescoping actuator shaft 508 which is used in lieu of actuator shaft 8 shown in FIGS. 1A and 1B. Referring to FIG. 6A, first telescoping arrangement 520 comprises a plurality of coil members 521 and an equal plurality of conductive members 525 enclosed in an insulating case 528.

Insulating case 528 comprises an exterior case which encloses coil members 521 and conducting members 525 as well as portions which extend into the interior of the exterior case to separate coil members 521 and conducting members 525 from one another. When viewed in a plane orthogonal to the viewing planes of FIGS. 6A and 6B, coil members 521 and conductive members 525 are substantially circular at their outer edges. Each coil member 521 and conductive member 525 comprises a central side, which is the side nearest to telescoping actuator shaft 508, and an outer side, which is the side furthest from telescoping actuator shaft 508.

Each coil member 521 comprises a central opening through which actuator shaft 508 is disposed and the central opening of each coil member 521 is distinct in size from the central opening of every other coil member 521. Each conductive member 525 also comprises a central opening through which actuator shaft 508 is disposed. For each conductive member 525, there is exactly one corresponding coil member 521 disposed directly above the conductive member 525 such that, when each conductive member 525 is disposed in the position shown in FIG. 6A, the outer side of the top surface of each conductive member 525 is directly adjacent to the bottom surface of its corresponding coil member 521. Telescoping actuator shaft 508 comprises a plurality of steps 523 equal to the number of coil members 521 and conductive members 525, and each conductive member 525 and its corresponding coil member 521 correspond to exactly one step 523. While FIGS. 6A and 6B depict first telescoping arrangement 520 comprising three coil members 521, three conductive members 525, and three steps 523, it will be appreciated that first telescoping arrangement 520 could comprise more or fewer than three coil members 521, three conductive members 525, and three steps 523 without departing from the scope of the disclosed concept.

Coil members 521 are fixedly positioned relative to the space surrounding the circuit interrupter. Conductive members 525 are not coupled to telescoping actuator shaft 508 or any other component, and each conductive member 525 is structured to move between the disposition shown in FIG. 6A and the disposition shown in FIG. 6B in which the central side of its bottom surface is adjacent to and resting on its corresponding step 523. The movement from the disposition shown in FIG. 6A to the disposition shown in FIG. 6B is depicted by arrows 526. When conductive members 525 are at rest in any position other than that shown in FIG. 6B (in which conductive members 525 are resting on top of their corresponding steps 523), their position in space is maintained by supplying steady AC current to coil members 521 and optionally including in first telescoping arrangement 520 a number of springs 527 (shown in FIG. 6A only) that provide support to conductive members 525. If included, optional springs 527 encircle telescoping actuator shaft 508 just above each step 523 such that the radius of each spring 527 lies in a plane orthogonal to the viewing plane of FIG. 6A.

Maintaining the position of a conductive member 525 in space by supplying steady AC current to its corresponding coil member 521 is achieved according to the principles detailed with respect to FIGS. 2A-2D. The steady RMS magnitude and time-varying orientation of AC current flowing through the conductor of coil member 521 generates a magnetic field with a substantially steady magnitude and time-varying orientation that causes the magnetic flux to vary as well. In turn, the magnetic field of coil member 521 induces eddy currents in the conductive member 525 that generate a magnetic field of substantially steady magnitude and time-varying orientation that varies at the same frequency as the AC current to oppose the change in magnetic flux of the magnetic field generated by the coil member 521. If optional springs 527 are included, it will be appreciated that springs with spring constants great enough to support the weight of conductive members 525 without fully compressing underneath the weight of conductive members 525 at rest would be used in order to ensure that each conductive member 525 has the ability to move downward and cause an impact to its corresponding step 521. Conductive members 525 must be able to move downward from the dispositions shown in FIG. 6A in order to effect opening stroke movement and damping of closing stroke movement of the telescoping actuator shaft 508 as described in further detail herein.

Each coil member 521 comprises a number of layers 522, each layer 522 comprising a distinct conductor wire wound into a coil that lies generally flat relative to a plane that is orthogonal to the viewing plane of FIGS. 6A and 6B. Each coil member 521 may comprise a number of layers 522 distinct from every other coil member 521. Each coil member 521 may be distinct from every other coil member 521 with respect to several attributes: the layers 522 of a given coil member 521 may be formed from a conductor material distinct from the material from which the layers 522 of every other coil member 521 are formed, the conductor wires used to form layers 522 of a given coil member 521 may have a diameter distinct from the diameter of conductor wires used to form layers 522 of every other coil member 521, the layers 522 of a given coil member 521 may comprise a number of coil turns distinct from the layers 522 of every other coil member 521, and the coils comprising the layers 522 may have a diameter distinct from the diameter of the coils comprising the layers 522 of every other coil member 521. Each layer 522 may be controlled, charged, and discharged by a processor (not shown) independently from every other layer 522.

Second telescoping arrangement 540 comprises a plurality of coil members 541 and an equal plurality of conductive members 545 enclosed in an insulating case 548. Insulating case 548 comprises an exterior case which encloses coil members 541 and conducting members 545 as well as portions which extend into the interior of the exterior case to separate coil members 541 and conducting members 545 from one another. When viewed in a plane orthogonal to the viewing plane of FIGS. 6A and 6B, coil members 541 and conductive members 545 are substantially circular at their outer edges. Each coil member 541 and conductive member 545 comprises a central side, which is the side nearest to telescoping actuator shaft 508, and an outer side, which is the side furthest from telescoping actuator shaft 508.

Each coil member 541 comprises a central opening through which telescoping actuator shaft 508 is disposed and the central opening of each coil member 541 is distinct in size from the central opening of every other coil member 541. Each conductive member 545 also comprises a central opening through which telescoping actuator shaft 508 is disposed. For each conductive member 545, there is exactly one corresponding coil member 541 disposed directly below the conductive member 545 such that, when each conductive member 545 is disposed in the position shown in FIG. 6A, the outer side of the bottom surface of each conductive member 545 is directly adjacent to the top surface of its corresponding coil member 541. Telescoping actuator shaft 508 comprises a plurality of steps 543 equal to the number of coil members 541 and conductive members 545, and each conductive member 545 and its corresponding coil member 541 correspond to exactly one step 543. While FIGS. 6A and 6B depict first telescoping arrangement 540 comprising three coil members 541, three conductive members 545, and three steps 543, it will be appreciated that first telescoping arrangement 540 could comprise more or fewer than three coil members 541, three conductive members 545, and three steps 543 without departing from the scope of the disclosed concept.

Coil members 541 are fixedly positioned relative to the space surrounding the circuit interrupter. Conductive members 545 are not coupled to telescoping actuator shaft 508 or any other component, and each conductive member 545 is structured to move between the disposition shown in FIG. 6A and the disposition shown in FIG. 6B in which the central side of its top surface is adjacent to its corresponding step 543. The movement from the disposition shown in FIG. 6A to the disposition shown in FIG. 6B is depicted by arrows 546. Conductive members 545 can be maintained at rest in positions other than those shown in FIG. 6A (in which conductive members 545 are resting on top of their corresponding steps 523) by supplying steady AC current to coil members 541. Supplying steady AC current to coil members 541 in order to maintain the positions of their corresponding conductive members 545 is analogous to supplying steady AC current to coil members 521 in order to maintain the positions of their corresponding conductive members 525, as described previously herein.

Each coil member 541 comprises a number of layers 542, each layer 542 comprising a distinct conductor wire wound into a coil that lies generally flat relative to a plane that is orthogonal to the viewing plane of FIGS. 6A and 6B. Each coil member 541 may comprise a number of layers 542 distinct from every other coil member 541. Each coil member 541 may be distinct from every other coil member 541 with respect to several attributes: the layers 542 of a given coil member 541 may be formed from a conductor material distinct from the material from which the layers 542 of every other coil member 541 are formed, the conductor wires used to form layers 542 of a given coil member 541 may have a diameter distinct from the diameter of conductor wires used to form layers 542 of every other coil member 541, the layers 542 of a given coil member 541 may comprise a number of coil turns distinct from the layers 542 of every other coil member 541, and the coils comprising the layers 542 may have a diameter distinct from the diameter of the coils comprising the layers 542 of every other coil member 541. Each layer 542 may be controlled, charged, and discharged by a processor (not shown) independently from every other layer 542. Conductive members 525, 545 may be produced from any conductive material.

The example embodiment shown in FIGS. 6A and 6B is particularly well-suited for providing a hammer-like wipe effect to break the weld that may form between separable contacts 4, 5 when separable contacts 4, 5 are closed. The example embodiment shown in FIGS. 6A and 6B generally works using the same principles of the embodiment shown in FIGS. 2A and 2B, wherein increasing and/or decreasing current is supplied to coil members 521, 541 to induce magnetic fields in conductive members 525, 545. The dispositions of conductive members 525, 545 immediately prior to the commencement of both an opening stroke and a closing stroke are the same and are shown in FIG. 6A.

To optimize the performance of first telescoping arrangement 520 for breaking a weld in an opening stroke, the coil member 521 nearest to moving stem 2 would be activated first, and each successive adjacent coil member would be activated such that the coil farthest from moving stem 2 would be activated last. For example, in FIG. 6A, coil member 521A would be activated first, coil member 521B would be activated second, and coil member 521C would be activated last. Accordingly, electromagnetic forces repelling conductive member 525A away from coil member 521A and toward its corresponding step 523A would be induced first, electromagnetic forces repelling conductive member 525B away from coil member 521B and toward its corresponding step 523B would be induced second, and electromagnetic forces repelling conductive member 525C away from coil member 521C and toward its corresponding step 523C would be induced last. It will be appreciated that, because telescoping actuator shaft 508 is at rest when coil member 521A is activated but already in motion when coil members 521B and 525C are activated, coil member 521B would need to impact step 523B with a greater force than the force at which coil member 521A impacts step 523A, and coil member 521C would need to impact step 523C with a greater force than the force at which coil member 521B impacts step 523B, in order to optimize the performance of first telescoping arrangement 520 for breaking a weld. Staggering the opening forces produced when conductive members 525A, 525B, 525C impact steps 523A, 523B, 523C is highly effective in breaking the weld that may have formed when separable contacts 4, 5 previously moved from an open state to a closed state. The disposition of conductive members 525A, 525B, and 525C after opening is shown in FIG. 6B. Optional springs 527 (shown in FIG. 6A) are not shown in FIG. 6B, however, it will be appreciated that if optional springs 527 are included in first telescoping arrangement 520, they would be in a state of maximum compression underneath conductive members 525 in FIG. 6B.

To dampen the effect of the opening forces produced by first telescoping arrangement 520 during the opening stroke, increasing current would be supplied at different times to coil members 541 to activate conductive members 545 at different times. In second telescoping arrangement 540, the coil member 541 nearest to latch 9 would be activated first, and each successive adjacent coil member would be activated such that the coil farthest from latch 9 would be activated last. For example, in FIG. 6A, coil member 541A would be activated first, coil member 541B would be activated second, and coil member 541C would be activated last. Accordingly, electromagnetic forces repelling conductive member 545A away from coil member 541A and toward its corresponding step 543A would be induced first, electromagnetic forces repelling conductive member 545B away from coil member 541B and toward its corresponding step 543B would be induced second, and electromagnetic forces repelling conductive member 545C away from coil member 541C and toward its corresponding step 543C would be induced last. The forces produced when conductive members 545A, 545B, 545C impact steps 543A, 543B, 543C oppose the opening forces produced by first telescoping arrangement 520 to dampen the opening forces. The disposition of conductive members 545A, 545B, and 545C after damping the opening forces is shown in FIG. 6B. While coil members 521A, 521B, 521C, 541A, 541B, 541C are described as being activated in a particular order above, it will be appreciated that coil members 521, 541 may be activated in any order desired by the user to adjust the opening and damping forces produced by coil actuator 501 without departing from the scope of the disclosed concept.

As previously stated, FIG. 6A shows the dispositions of conductive members 525, 545 immediately prior to both an opening stroke and a closing stroke. Accordingly, when conductive members 525, 545 are in the dispositions shown in FIG. 6B after the conclusion of an opening stroke, they should restored to the dispositions shown in FIG. 6A in preparation for the commencement of the next closing stroke. To restore conductive members 525, 545 to the dispositions shown in FIG. 6A, decreasing current can be supplied to coil members 521, 541 to generate electromagnetic forces that attract conductive members 525, 545 toward coil members 521, 541. It will be appreciated moving the conductive members 525, 545 from the dispositions shown in FIG. 6B to the dispositions shown in FIG. 6A requires supplying current of smaller magnitudes to coil members 521, 541 than the magnitudes required to generate repulsion forces and damping forces that impact telescoping actuator shaft 508 with enough force to move telescoping actuator shaft 508 between the open and closed states. In addition, it will be appreciated that conductive members 545 can be returned to the dispositions shown in FIG. 6A by supplying no current to coil members 541 and simply allowing gravity to pull conductive members 545 downward, or by supplying a slightly increasing current to coil members 141 to generate electromagnetic forces that slightly repulse conductive members 545 away from coil members 541 without overcoming the downward pull of gravity such that conductive members 545 return to the dispositions shown in FIG. 6A at a slower speed than they would due to the force of gravity alone.

After conductive members 525, 545 have been restored to the dispositions shown in FIG. 6A, the steps implemented to generate the opening forces and damping forces for an opening stroke can also be implemented to execute a closing stroke when implemented in a different sequence. In one non-limiting example implementation of a closing stroke, the coils 541 would be activated first and the coils 521 would be activated second, as opposed to activating the coils 521 first and activating the coils 541 second as was described for an opening stroke. In the example, coil member 541A would be activated first, coil member 541B would be activated second, and coil member 541C would be activated last. Accordingly, electromagnetic forces repelling conductive member 545A away from coil member 541A and toward its corresponding step 543A would be induced first, electromagnetic forces repelling conductive member 545B away from coil member 541B and toward its corresponding step 543B would be induced second, and electromagnetic forces repelling conductive member 545C away from coil member 541C and toward its corresponding step 543C would be induced last. The disposition of conductive members 545A, 545B, and 545C after closing is shown in FIG. 6B. It will be appreciated that closing separable contacts 4, 5 may require inducing electromagnetic forces of a smaller magnitude than those required to break the weld between separable contacts 4, 5 during an opening stroke.

To dampen the closing stroke in the same example, coil member 521A could be activated first, coil member 521B could be activated second, and coil member 521A could be activated last. Accordingly, electromagnetic forces repelling conductive member 525A away from coil member 521A and toward its corresponding step 523A would be induced first, electromagnetic forces repelling conductive member 525B away from coil member 521B and toward its corresponding step 523B would be induced second, and electromagnetic forces repelling conductive member 525C away from coil member 521C and toward its corresponding step 523C would be induced last. The forces produced when conductive members 525A, 525B, 525C impact steps 523A, 523B, 523C oppose the closing forces produced by second telescoping arrangement 540 to dampen the closing forces. The disposition of conductive members 525A, 525B, and 525C after damping the closing forces is shown in FIG. 6B. While coil members 541A, 541B, 541C, 521A, 521B, 521C are described as being activated in a particular order above, it will be appreciated that coil members 541, 521 may be activated in any order desired by the user to adjust the closing and damping forces produced by coil actuator 501 without departing from the scope of the disclosed concept. It will also be appreciated that when conductive members 525, 545 are in the dispositions shown in FIG. 6B after the conclusion of a closing stroke, they should restored to the dispositions shown in FIG. 6A in preparation for the commencement of the next opening stroke by supplying decreasing currents to 521, 541 or by the other methods previously described with respect to preparing for the commencement of a closing stroke after the conclusion of an opening stroke.

Figure 6C:
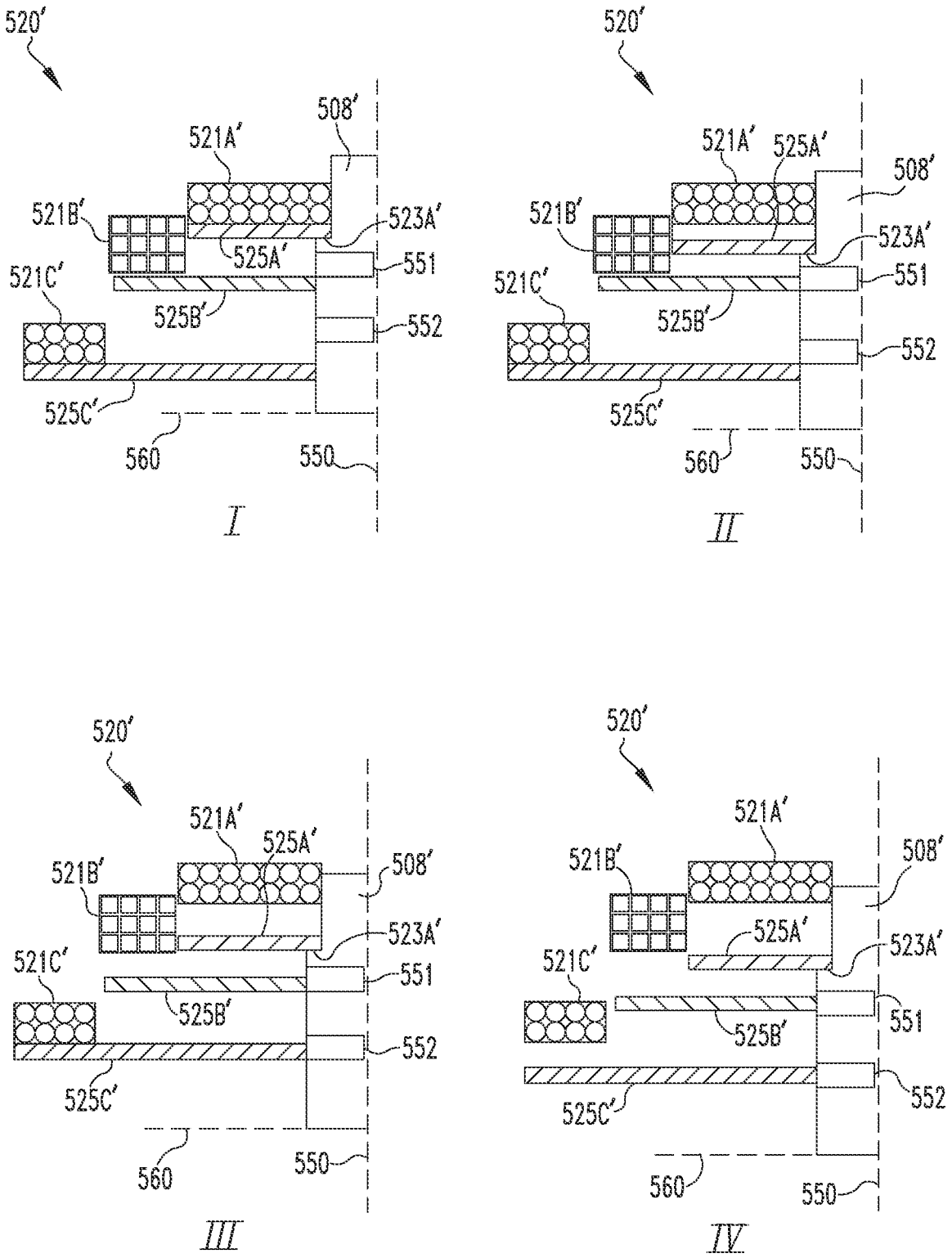
Figure 6D:
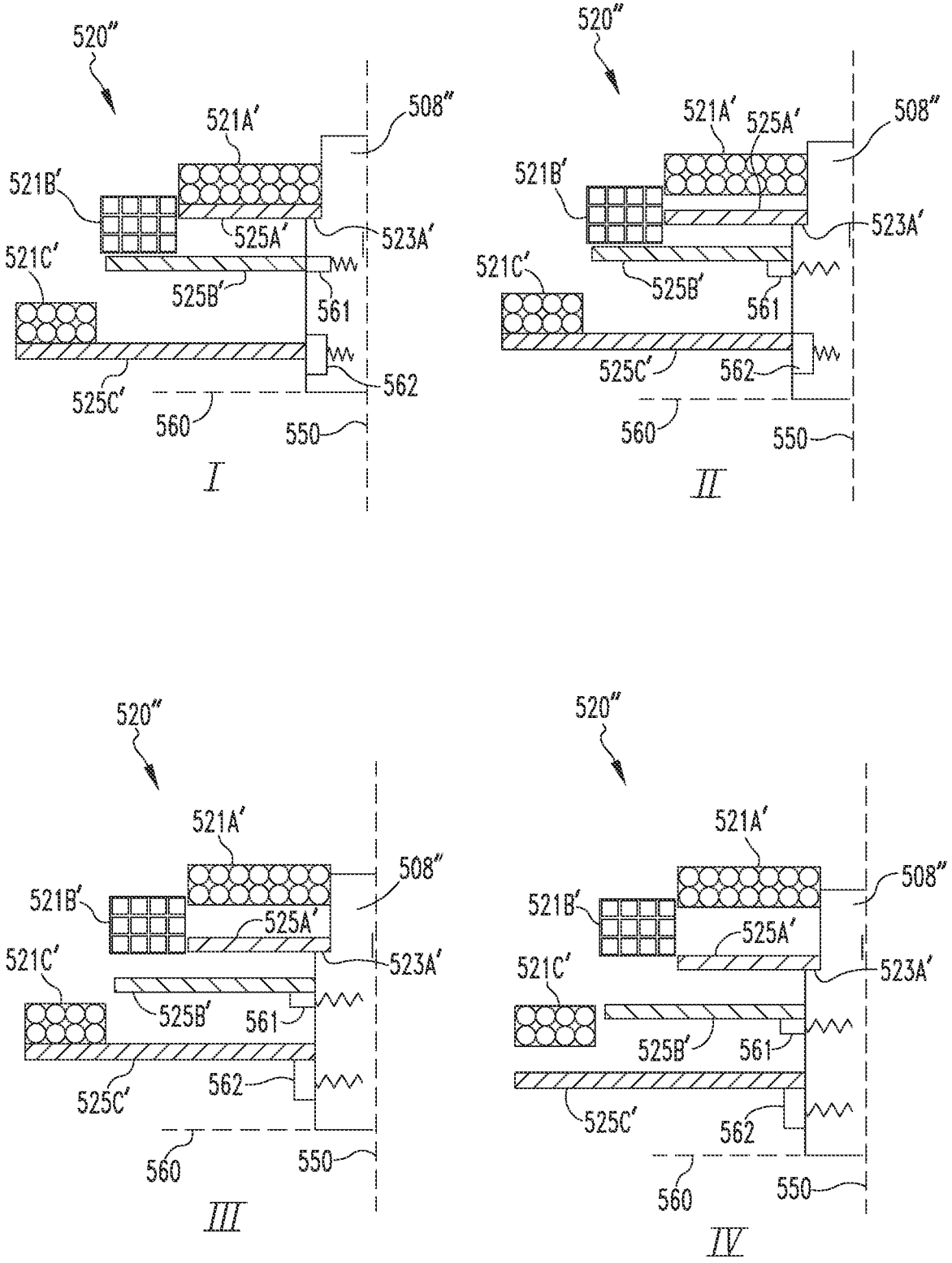

In other example embodiments, a first telescoping arrangement 520' or first telescoping arrangement 520" replaces and represents a variation of first telescoping arrangement 520 in coil actuator 501. FIGS. 6C and 6D each show a left half of a cross-sectional view of first telescoping arrangements 520' (FIG. 6C), 520" (FIG. 6D), which comprise coil members 521A', 521B', 521C' and conductive members 525A', 525B', 525C'. Coil members 521A', 521B', 521C' and conductive members 525A', 525B', 525C' comprise structures functionally equivalent to the coil members 521A, 521B, 521C and conductive members 525A, 525B, and 525C, respectively, shown in FIGS. 6A and 6B. Only the left halves and top halves of the cross-sectional view of first telescoping arrangements 520', 520" and telescoping actuator shafts 508', 508" are shown in FIGS. 6C and 6D in order to display four successive stages of coil activation side-by-side, however, it will be appreciated that first telescoping arrangements 520', 520" and telescoping actuator shafts 508', 508" each additionally comprise a right half which is reflectively symmetrical to the left half over an axis of symmetry 550 and a bottom half which is reflectively symmetrical to the top half over an axis of symmetry 560 (the bottom half of first telescoping arrangements 520', 520" being analogous to second telescoping arrangement 540). In addition, it will be appreciated that the top half of coil actuator 501 could comprise any of the first telescoping arrangements 520, 520', 520" combined with either second telescoping arrangement 540 or a variation of second telescoping arrangement 540 analogous to 520', 520" without departing from the scope of the disclosed concept.

Telescoping actuator shafts 508', 508" include a number of clutches in conjunction with step 523A' to engage with conductive members 525A', 525B', 525C' in lieu of solely using a series of steps 523, as first telescoping arrangement 520 does. More specifically, telescoping actuator shafts 508', 508" utilize clutch mechanisms to engage conductive members 525B', 525C' once an opening stroke has commenced and telescoping actuator shafts 508', 508" are in motion. FIG. 6C depicts telescoping actuator shaft 508' utilizing friction or magnetic clutches to engage conductive members 525B', 525C', while FIG. 6D depicts telescoping actuator shaft 508" utilizing mechanical clutches to engage conductive members 525B', 525C'. Similarly to how the performance of first telescoping arrangement 520 is optimized for breaking a weld during an opening stroke by activating coil members 521 in the order described with respect to FIG. 6A, the performance of first telescoping arrangement 520' is optimized by activating coil member 521A' first, coil member 521B' second, and coil member 521C' last.

Four stages of an opening stroke are depicted in FIG. 6C: stage I, stage II, stage III, and stage IV. In stage I, coil member 521A' is activated first such that electromagnetic forces repelling conductive member 525A' away from coil member 521A' and toward its corresponding step 523A' are generated, and telescoping actuator shaft 508' moves downward. The downward movement of actuator shaft 508' initiated in stage I results in the disposition of telescoping actuator shaft 508' shown in stage II, wherein engagement zone 551 aligns with conductive member 525B' and engages conductive member 525B' with friction or magnetic forces such that conductive member 525B' and telescoping actuator shaft 508' are fixedly coupled. In stage II, coil member 521B' is activated such that electromagnetic forces repelling conductive member 525B' away from coil member 521B' are generated and telescoping actuator shaft 508' moves further downward. The further downward movement of actuator shaft 508' effected in stage II results in the disposition of telescoping actuator shaft 508' shown in stage III, wherein engagement zone 552 aligns with conductive member 525C' and engages conductive member 525C' with friction or magnetic forces such that conductive member 525C' and telescoping actuator shaft 508' are fixedly coupled. In stage III, coil member 521C' is activated such that electromagnetic forces repelling conductive member 525C' away from coil member 521C' are generated and telescoping actuator shaft 508' moves even further downward, to its final open position as shown in stage IV.

FIG. 6D similarly depicts four stages of an opening stroke: stage I, stage II, stage III, and stage IV. In stage I, coil member 521A' is activated first such that electromagnetic forces repelling conductive member 525A' away from coil member 521A' and toward its corresponding step 523A' are generated, and telescoping actuator shaft 508" moves downward. The downward movement of actuator shaft 508' initiated in stage I results in the disposition of telescoping actuator shaft 508" shown in stage II, wherein clutch 561 protrudes through an opening in telescoping actuator shaft 508" to form a shelf underneath conductive member 525B', as depicted in stage II. In stage II, coil member 521B' is activated such that electromagnetic forces repelling conductive member 525B' away from coil member 52BA' are generated, causing conductive member 525B' to impact clutch 561 and perpetuate the downward movement of telescoping actuator shaft 508". The further downward movement of actuator shaft 508" effected in stage II results in the disposition of telescoping actuator shaft 508" shown in stage III, wherein clutch 562 protrudes through an opening in telescoping actuator shaft 508' to form a shelf underneath conductive member 525C', as depicted in stage III. In stage III, coil member 521C' is activated such that electromagnetic forces repelling conductive member 525C' away from coil member 521C' are generated, causing conductive member 525C' to impact clutch 562 and perpetuate the downward movement of telescoping actuator shaft 508" even further, toward its final open position shown in stage IV.

While FIGS. 6C and 6D depict first telescoping arrangements 520', 520" comprising a certain number of coil members, conductive members, steps, and clutching mechanisms such as engagement zones 551, 552 and mechanical clutches 561, 562, it will be appreciated that first telescoping arrangements 520', 520" could comprise different quantities of these enumerated components than are shown in FIGS. 6C and 6D without departing from the scope of the disclosed concept.

Figure 7A:
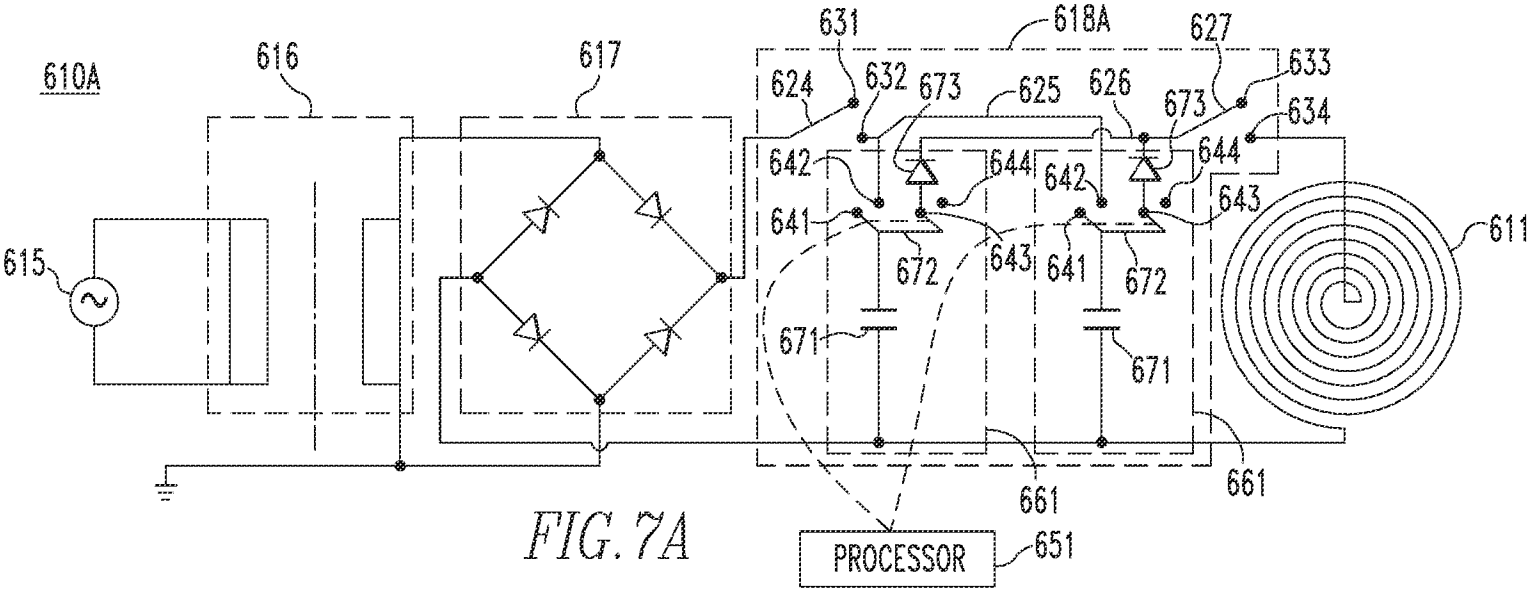
FIG. 7A is a schematic diagram of a power source arrangement for a coil actuator of a circuit interrupter including a multi-capacitor bank arrangement in accordance with an example embodiment of the disclosed concept.

FIG. 7A shows a schematic diagram of a power source arrangement 610A structured to be used with a coil actuator, including but not limited to any of the coil actuators previously described with respect to FIGS. 2A-2B, 3A-3B, 4A-4B, 5, and 6 and shown schematically in FIGS. 1A-1B, in accordance with an example embodiment of the disclosed concept. Coil member 611 is analogous to previously described coils 111, 211, 311, 411, and coil members 521, 541. Power from an AC power source 615, such as utility power, is input to the primary side of a transformer 616 and power output by the secondary side of transformer 616 is input to rectifier 617. Power output from rectifier 617 is DC and is input to capacitive charging arrangement 618A via a main charging relay 624. Current output from charging arrangement 618A is input to coil member 611 via a main discharging relay 627. Charging arrangement 618A comprises a plurality of capacitor banks 661 structured to be electrically connected to one another via a charging conductor 625 and a discharging conductor 626. Each capacitor bank 661 comprises a capacitor 671, a bank relay 672, and a discharge LED 673.

Main charging relay 624 is shown disposed in an open state such that terminal 631 is not in electrical contact with terminal 632 of charging conductor 625. Main charging relay 624 is said to be disposed in a closed state (not shown) when terminal 631 is in electrical contact with terminal 632 of charging conductor 625. Charging terminals 641 of each bank relay 672 are shown disposed in an open state such that they are not in electrical contact with terminals 642 of charging conductor 625. Charging terminals 641 of each bank relay 672 are said to be disposed in a closed state (not shown) when they are in electrical contact with terminals 642 of charging conductor 625. Discharging terminals 643 of each bank relay 672 are shown disposed in a closed state such that they are in electrical contact with both discharge LEDs 673 and discharging conductor 626. Discharging terminals 643 of each bank relay 672 are said to be disposed in an open state (not shown) when they are in electrical contact with terminals 44 instead of discharge LEDs 673 and therefore are not in electrical contact with discharging conductor 626. Main discharging relay 627 is shown disposed in an open state such that terminal 633 is not in electrical contact with an input terminal 634 of coil member 611. Main discharging relay 627 is said to be disposed in a closed state (not shown) when terminal 633 is in electrical contact with input terminal 634 of coil member 611.

When main charging relay 624 is disposed in a closed state, and terminal 641 of a particular bank relay 672 is disposed in a closed state, the associated capacitor bank 661 will be in a charging state such that its capacitor 671 will get charged by the output of rectifier 617, provided that: either (1) main discharging relay 627 is disposed in an open state, or (2) discharging terminal 643 of that particular bank relay 672 is disposed in an open state. When main discharging relay 627 is disposed in a closed state, and discharging terminal 643 of a particular bank relay 672 is disposed in a closed state, the associated capacitor bank 661 will be in a discharging state such that its capacitor 671 will discharge current to the input of coil member 611, provided that: either (1) main charging relay 624 is disposed in an open state, or (2) charging terminal 641 of that particular bank relay 672 is disposed in an open state. A processor 651 may be used to control charging terminals 641 and discharging terminals 643 to move between closed and open states.

Figure 7B:
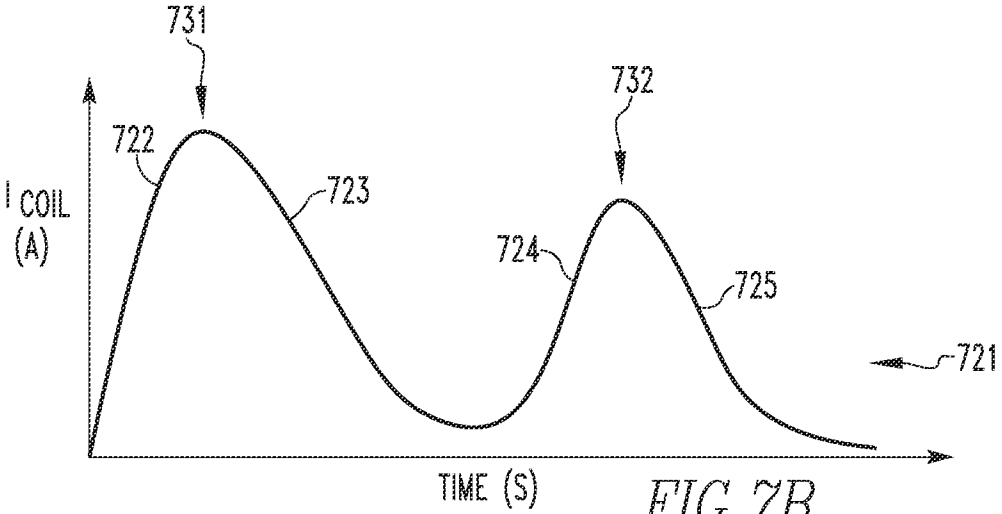
FIG. 7B is a graph of a current profile produced by the power source arrangement shown in FIG. 7A in accordance with an example embodiment of the disclosed concept.

FIG. 7B shows a graph of the waveform 721 of an example current $I_{coil}$ output by charging arrangement 618A to input terminal 634 of coil member 611 in FIG. 7A.

Current $I_{coil}$ is analogous to current $I_{coil}$ described with respect to FIGS. 2A-2B and other previously discussed figures. Upward slopes 722, 724 depict those times when $I_{coil}$ is increasing, and accordingly, those times when a conductive member corresponding to a coil member is repelled away from the coil member. Downward slopes 723, 725 depict those times when $I_{coil}$ is decreasing and accordingly, those times when a conductive member is attracted toward a corresponding coil member. The two pulses 731, 732 in waveform 721 result from the inclusion of two capacitor banks 661 in charging arrangement 618A. More specifically, each pulse in waveform 721 results from each charged capacitor bank 661 discharging at a different time than the other. Waveform 721 represents an opening stroke, and the peak of the first pulse 731 represents acceleration of moving stem 2 during the opening stroke. Downward slope 723 and the second pulse 732 depict damping of the initial acceleration of moving stem 2.

While FIG. 7A depicts an example charging arrangement 618A comprising two capacitor banks 661, it will be appreciated that charging arrangement 618A may comprise more than two capacitor banks 661 without departing from the scope of the disclosed concept. The waveform 721 of $I_{coil}$ for a charging arrangement 618A may comprise as many pulses as there are capacitor banks 661. The inclusion of more than one capacitor bank 661 in charging arrangement 618A facilitates nuanced damping, and represents an improvement over existing technology which generally utilizes one capacitor bank to produce a single pulse of current. It will be further appreciated that in embodiments comprising multiple coils and employing charging arrangement 618A, a separate processor 651 may be used to control charging terminals 641 and discharging terminals 643 to achieve fine adjustments in opening or closing stroke velocity and damping. In one example, with respect to the embodiment shown in FIG. 5, each of the plurality of coil layers 421 in a multilayer coil 411 may be controlled by a processor 651 independently of each of the other coil layers 421, and each of the plurality of conductor layers 441 in composite conductive member 412 may be controlled by a processor 651 independently of each of the other conductive layers 441. In another example, with respect to the embodiment shown in FIGS. 6A and 6B, each of the number of layers 522 in a coil member 521 may be controlled by a processor 651 independently of each of the other layers 522, and each of the number of layers 542 in a coil member 541 may be controlled by a processor 651 independently of each of the other layers 542.

Figure 8A:
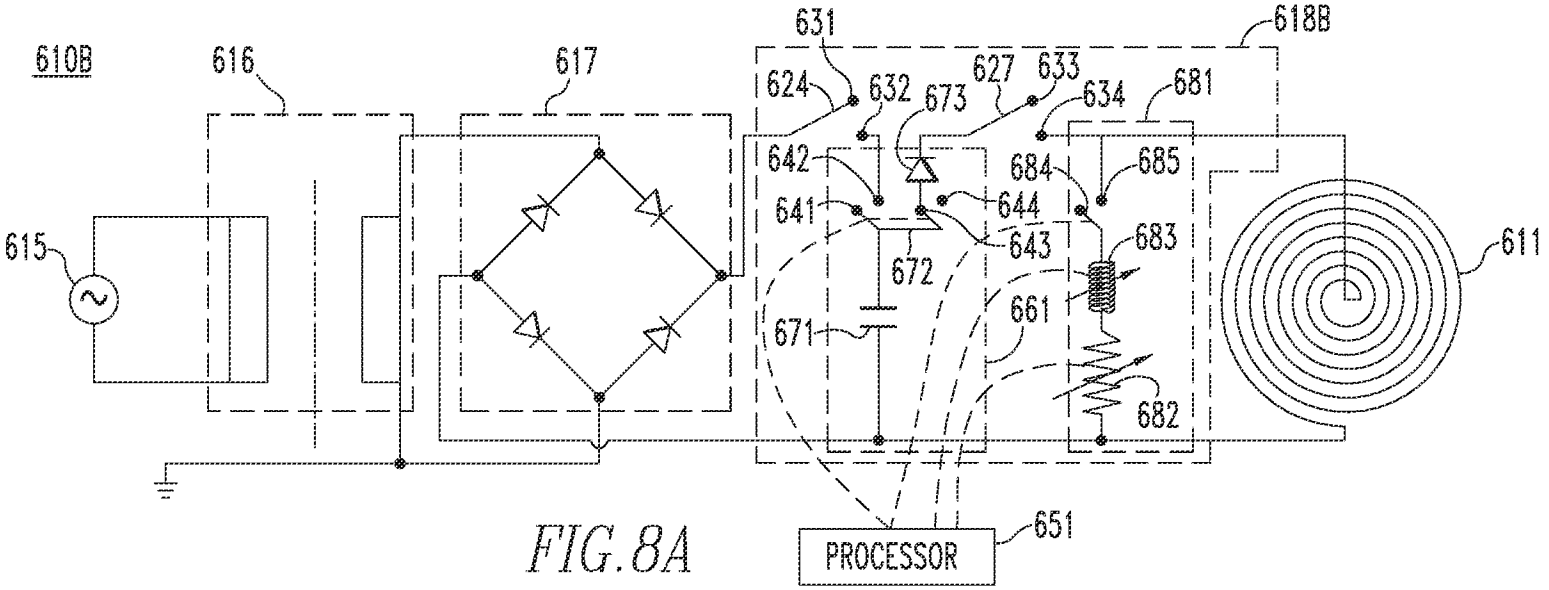
FIG. 8A is a schematic diagram of a power source arrangement for a coil actuator of a circuit interrupter including a ramp-down circuit in accordance with an example embodiment of the disclosed concept.

FIG. 8A shows a schematic diagram of a power source arrangement 610B similar to power source arrangement 610A, but with a charging arrangement 618B distinct from charging arrangement 618A, in accordance with an example embodiment of the disclosed concept. Charging arrangement 618A comprises a ramp-down circuit 681 structured to be electrically connected to a capacitor bank 661 via main discharge relay 627 and structured to be electrically connected to the input of coil member 611. Ramp-down circuit 681 comprises a variable resistor 682 and a variable inductor 683. Ramp-down switch 684 is shown disposed in an open state such that it is not in electrical contact with input terminal 634 of coil member 611. Ramp-down switch 684 is said to be disposed in a closed state (not shown) when it is in electrical contact with terminal 685. Processor 651 may be used to control ramp-down switch 684 to move between closed and open states, to vary the resistance of variable resistor 682, and to vary the inductance of variable inductor 683. The inclusion of ramp-down circuit 681 in charging arrangement 618B is structured to increase the rate at which a pulse of current discharged by capacitor bank 661 decreases, when compared to charging arrangement 618A. Specifically, when main discharging relay 627 is disposed in a closed state and ramp-down switch 684 is disposed in a closed state, ramp-down circuit 681 increases the rate at which a pulse of current discharged by capacitor bank 661 and input to coil member 611 decreases.

Figure 8B:
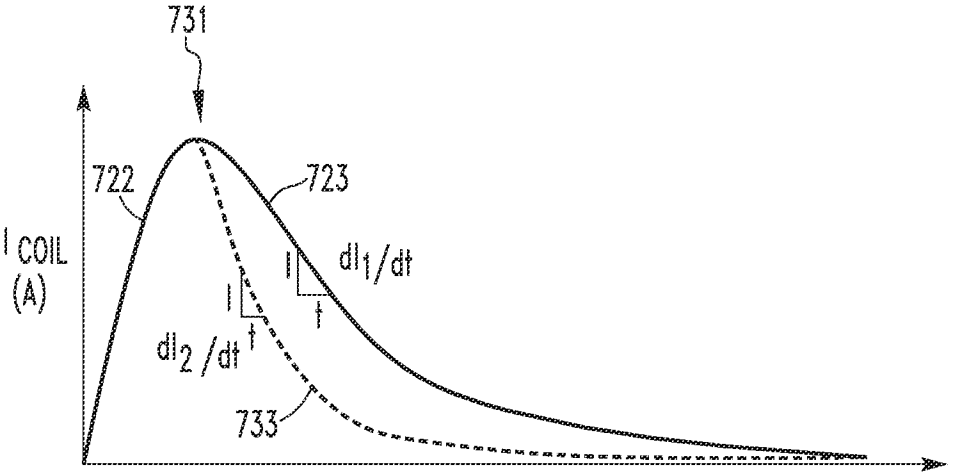
FIG. 8B is a graph of a current profile produced by the power source arrangement shown in FIG. 8A in accordance with an example embodiment of the disclosed concept.

FIG. 8B shows a graph of the waveform of first pulse 731 of current $I_{coil}$ shown in FIG. 7B, and additionally shows an alternate downward slope 733 of pulse 731 that can result instead of downward slope 723 when charging arrangement 618B is used instead of charging arrangement 618A, representing a change to the rate of decrease of $I_{coil}$ that can be effected by using charging arrangement 618B instead of charging arrangement 618A. The magnitude of the change in current $dI_2/dt$ depicted by downward slope 733 is greater than magnitude of the change in current $dI_1/dt$ depicted by downward slope 723, demonstrating how ramp-down circuit 681 can increase the rate of decrease of a pulse of current $I_{coil}$ 731 discharged by capacitor bank 661. An increased rate of decrease of $I_{coil}$ induces a greater electromagnetic attraction between a conductive member and a corresponding coil member, resulting in increased damping of the initial acceleration of moving stem 2 during an opening stroke. It will be appreciated that varying the resistance of variable resistor 682 and varying the inductance of variable inductor 683 will vary the rate of decrease of current $I_{coil}$ discharged by capacitor bank 661.

Figure 9A:
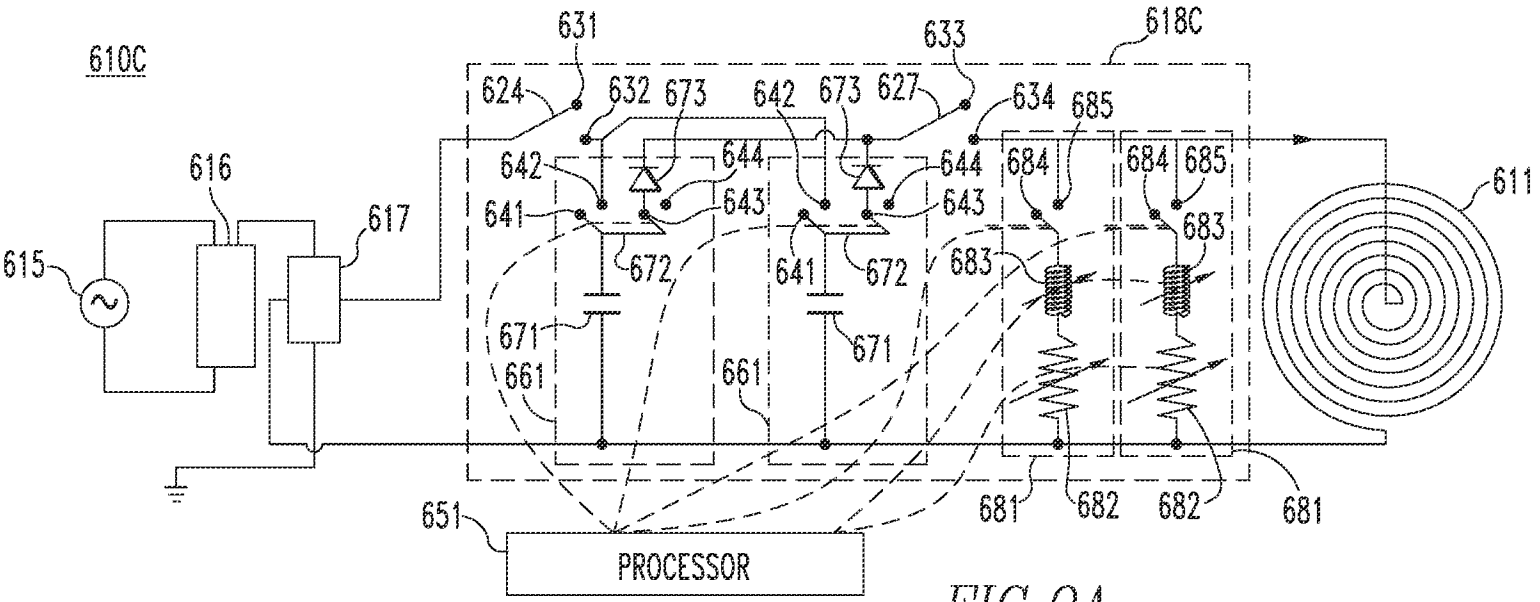
FIG. 9A is a schematic diagram of a power source arrangement for a coil actuator of a circuit interrupter including a multi-capacitor bank arrangement and ramp-down circuits in accordance with an example embodiment of the disclosed concept.

FIG. 9A shows a schematic diagram of a power source arrangement 610C using a charging arrangement 618C that effectively combines the functionality of charging arrangements 618A and 618B, in accordance with an example embodiment of the disclosed concept. Transformer 616 and rectifier 617 are depicted in block form. The inclusion of a plurality of capacitor banks 661 and a plurality of ramp-down circuits 681 enables each of the distinct pulses of current that may be effectuated by each of the capacitor banks 661 to be increased or decreased at varying rates by each of the ramp-down circuits 681. While FIG. 9A depicts an example charging arrangement 618C comprising two capacitor banks 661 and two ramp-down circuits 681, it will be appreciated that charging arrangement 618C may comprise more than two capacitor banks 661 and more than two ramp-down circuits 681 without departing from the scope of the disclosed concept.

Figure 9B:
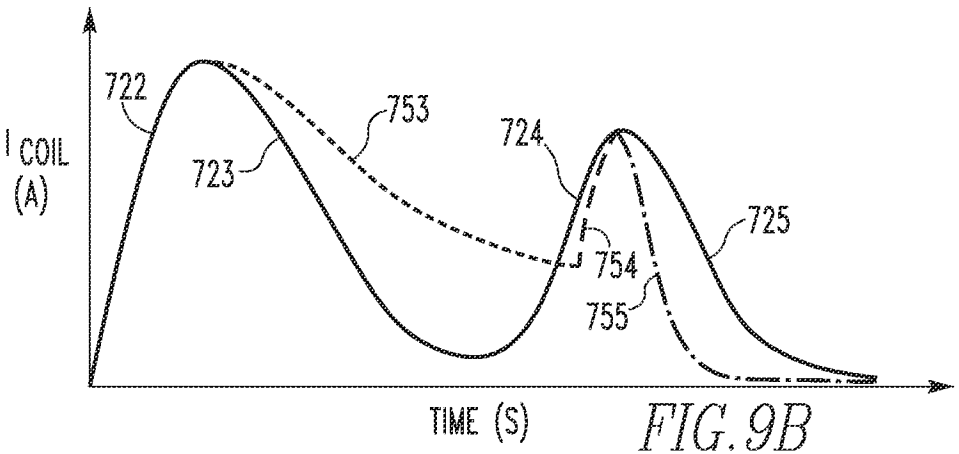
FIG. 9B is a graph of a current profile produced by the power source arrangement shown in FIG. 9A in accordance with an example embodiment of the disclosed concept.

FIG. 9B shows a graph of the upward slopes 722, 724 and downward slopes 723, 725 of waveform 721 shown in FIG. 7B, and additionally shows additional downward and upward slopes that can result when charging arrangement 618C is used instead of charging arrangement 618A, representing changes to the rates of decrease and increase of $I_{coil}$ that can be effected by using charging arrangement 618C instead of charging arrangement 618A. In one example, a ramp-down circuit 681 can be used to effect a slower rate of decrease of current $I_{coil}$ (depicted by downward slope 753) discharged by a first capacitor bank 661 than would occur without the use of a first ramp-down circuit 681 (depicted by downward slope 723). The slower rate of decrease of current $I_{coil}$ decreases the attraction of a conductive member toward its corresponding coil member and slows the resulting velocity of the corresponding coil actuator. In another example, if processor 651 causes an increase to current $I_{coil}$ while current $I_{coil}$ is still decreasing as depicted by downward slope 753 and before current $I_{coil}$ decreases to a level denoted by point 741, for example and without limitation by discharging current from a second capacitor bank 661, such that current $I_{coil}$ increases to a level denoted by point 742 at the point in time denoted by point 742, then the waveform of $I_{coil}$ resulting from such an increase would be represented by upward slope 754 having a steeper slope than upward slope 724, indicating a greater rate of increase of current $I_{coil}$ than would occur without the use of the first ramp-down circuit 681 to decrease the rate of initial decrease of current $I_{coil}$. The faster rate of increase of current $I_{coil}$ increases the repulsion between a conductive member and its corresponding coil member and increases the resulting velocity of the corresponding coil actuator. In another example, downward slope 755 denoting a faster rate of decrease of current $I_{coil}$ than the rate of decrease denoted by downward slope 725 indicates the use of a second ramp-down circuit 681 using different resistance and inductance values than the first ramp-down circuit 681. The faster rate of decrease of current $I_{coil}$ increases the attraction of a conductive member toward its corresponding coil member and increases the resulting velocity of the corresponding coil actuator.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An actuator structured to move a moving stem of a circuit interrupter, the actuator comprising:

a shaft structured to be coupled to the moving stem;

a first conductive member coupled to a first location of the shaft;

a conductive coil member disposed at a second location of the shaft and having an opening through which the shaft passes; and a second conductive member coupled to a third location of the shaft;

wherein the second location is disposed between the first location and the third location such that the coil is disposed between the first conductive member and the second conductive member, wherein the third location is disposed closer to the moving stem than the first location such that the second conductive member is disposed closer to the moving stem than the first conductive member, wherein the coil member is structured to be electrically connected to a current source, and wherein the second conductive member differs from the first conductive member in either material composition or structure.

2. The actuator of claim 1, wherein the second conductive member has a higher resistivity than the first conductive member.

3. The actuator of claim 2, wherein the second conductive member is produced from a different material than the first conductive member.

4. The actuator of claim 2, wherein the second conductive member is coated with a material causing the second conductive member to have the higher resistivity.

5. The actuator of claim 2, wherein the first conductive member is coated with a material causing the first conductive member to have a lower resistivity than the second conductive member.

6. The actuator of claim 2, wherein the second conductive member is produced to have a different surface area than the first conductive member.

7. The actuator of claim 2, wherein the second conductive member is produced to have different cross-sectional dimensions than the first conductive member.

8. The actuator of claim 2, wherein the first conductive member and the second conductive member are both planar.

9. The actuator of claim 1, wherein the first conductive member is planar, wherein the second conductive member is a toroid and comprises a central opening that contains an axis of revolution of the toroid, and wherein the shaft is disposed in the central opening of the second conductive member.

10. The actuator of claim 9, wherein a cross-sectional area of the toroid is rectangular.

11. The actuator of claim 9, wherein a cross-sectional area of the toroid is circular.

* * * * *